US010696454B1

(12) United States Patent
Wang et al.

(10) Patent No.: US 10,696,454 B1
(45) Date of Patent: Jun. 30, 2020

(54) COMBINATION CARRYING DEVICE

(71) Applicant: Amazon Technologies, Inc., Seattle, WA (US)

(72) Inventors: Xiao Wang, Seattle, WA (US); Thomas Duester, Munich (DE); Ashley Anne Arhart, Seattle, WA (US); Matthew James Bird, Seattle, WA (US); Jason Michael Famularo, Seattle, WA (US); Aaron Benjamin Nather, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 122 days.

(21) Appl. No.: 14/667,432

(22) Filed: Mar. 24, 2015

Related U.S. Application Data

(63) Continuation-in-part of application No. 14/583,552, filed on Dec. 26, 2014.

(51) Int. Cl.
*B65D 25/16* (2006.01)
*B65D 25/28* (2006.01)

(52) U.S. Cl.
CPC ..... *B65D 25/2852* (2013.01); *B65D 25/16* (2013.01)

(58) Field of Classification Search
CPC .. B65D 77/04; B65D 77/042; B65D 77/0446; B65D 77/044; B65D 81/3825
USPC ..... 220/495, 772; 206/515, 516
See application file for complete search history.

(56) References Cited

U.S. PATENT DOCUMENTS

| | | | | |
|---|---|---|---|---|
| 3,032,230 | A | 5/1962 | Gerber | |
| 3,423,004 | A | 1/1969 | Christensson | |
| D259,819 | S * | 7/1981 | Cornou | D3/307 |
| 4,642,934 | A | 2/1987 | Carlson et al. | |
| 5,337,910 | A * | 8/1994 | Picozza | A23B 7/10 220/322 |
| 5,469,986 | A | 11/1995 | Jang | |
| 5,938,035 | A | 8/1999 | Oglesby et al. | |
| 7,163,120 | B1 * | 1/2007 | Blucher | A47J 36/16 220/573.4 |
| 7,225,980 | B2 | 6/2007 | Ku et al. | |

(Continued)

FOREIGN PATENT DOCUMENTS

JP 3124104 U 8/2006

OTHER PUBLICATIONS

Abhaya Asthana et al., "An Indoor Wireless System for Personalized Shopping Assistance", Proceedings of IEEE Workshop on Mobile Computing Systems and Applications, 1994, pp. 69-74, Publisher: IEEE Computer Society Press.

(Continued)

*Primary Examiner* — Jeffrey R Allen
(74) *Attorney, Agent, or Firm* — Athorus, PLLC

(57) ABSTRACT

A combination carrying device includes a rigid basket having a flexible bag nested therein. The flexible bag may be formed from one or more fabrics or like materials and define a tapered volume having a pair of handle extensions. The rigid basket may be formed from plastics or like materials and include rotatable handles mounted to sides of the rigid basket via one or more mounting bores. A customer carrying a combination carrying device in a retail establishment may place one or more items in the flexible bag nested within the rigid basket, and extract the flexible bag from the rigid basket after executing a purchase for the items therein.

29 Claims, 28 Drawing Sheets

(56) References Cited

U.S. PATENT DOCUMENTS

| | | | | |
|---|---|---|---|---|
| 7,318,247 | B2 | 1/2008 | Libman et al. | |
| 7,320,411 | B1 | 1/2008 | Shenosky et al. | |
| 7,669,713 | B2 * | 3/2010 | Stahl | B65D 21/0216 206/506 |
| 7,949,568 | B2 | 5/2011 | Fano et al. | |
| 8,009,864 | B2 | 8/2011 | Linaker et al. | |
| 8,175,925 | B1 | 5/2012 | Rouaix | |
| 8,189,855 | B2 | 5/2012 | Opalach et al. | |
| 8,423,431 | B1 | 4/2013 | Rouaix et al. | |
| 8,630,924 | B2 | 1/2014 | Groenevelt et al. | |
| 8,688,598 | B1 | 4/2014 | Shakes et al. | |
| 9,473,747 | B2 | 10/2016 | Kobres et al. | |
| 2003/0002712 | A1 | 1/2003 | Steenburgh et al. | |
| 2003/0017930 | A1 * | 1/2003 | Aizawa | B04B 5/0421 494/20 |
| 2004/0016784 | A1 | 1/2004 | Berry | |
| 2004/0181467 | A1 | 9/2004 | Raiyani et al. | |
| 2007/0160783 | A1 * | 7/2007 | Rieser | A22C 13/0013 428/34.8 |
| 2008/0055087 | A1 | 3/2008 | Horii et al. | |
| 2008/0077511 | A1 | 3/2008 | Zimmerman | |
| 2008/0109114 | A1 | 5/2008 | Orita et al. | |
| 2008/0128429 | A1 | 6/2008 | Towery et al. | |
| 2009/0080808 | A1 | 3/2009 | Hagen | |
| 2009/0121017 | A1 | 5/2009 | Cato et al. | |
| 2009/0180715 | A1 | 7/2009 | Wittke-Kothe | |
| 2009/0245573 | A1 | 10/2009 | Saptharishi et al. | |
| 2011/0011936 | A1 | 1/2011 | Morandi et al. | |
| 2012/0284132 | A1 | 11/2012 | Kim et al. | |
| 2013/0076898 | A1 | 3/2013 | Philippe et al. | |
| 2013/0253700 | A1 | 9/2013 | Carson et al. | |
| 2013/0277265 | A1 | 10/2013 | Varbanov | |
| 2014/0279294 | A1 | 9/2014 | Field-Darragh et al. | |
| 2015/0019391 | A1 | 1/2015 | Kumar et al. | |
| 2015/0073907 | A1 | 3/2015 | Purves et al. | |

OTHER PUBLICATIONS

Cristian Pop, "Introduction to the BodyCom Technology", Microchip AN1391, May 2, 2011, pp. 1-26, vol. AN1391, No. DS01391A, Publisher: 2011 Microchip Technology Inc.

* cited by examiner

COMBINATION CARRYING DEVICE

CROSS-REFERENCE TO RELATED APPLICATIONS

This application is a continuation-in-part of U.S. patent application Ser. No. 14/583,522, filed Dec. 26, 2014, the contents of which are incorporated by reference herein in their entirety.

BACKGROUND

Materials handling facilities such as warehouses or retail stores often provide durable item carriers to users, who may utilize the item carriers when transporting items throughout the facilities. For example, such facilities commonly provide users with carts, e.g., large vessels formed from metal or plastic that are configured to travel on wheels, as well as baskets or totes having substantially smaller vessels that may be carried by users with one or more handles.

If a user identifies one or more items that he or she intends to retrieve from a shelf or other location within a materials handling facility, the user may remove the items, place the items into an item carrier, and transport the items in the item carrier to an intended destination such as a distribution station or cash register, where the user may transfer the items from the item carrier to another facility at the destination or otherwise transition the items to another human operator or automated agent. When the user transfers the items at the intended destination, or transitions the items to the human operator or the automated agent, the user or the human operator must manually remove the items from the item carrier, and then relinquish control over the item carrier back to the materials handling facility. If such items feature an awkward or unmanageable shape, or lack a handle, the items may be removed from the item carrier and placed inside a plastic or fabric bag, or like container, to aid in the transfer or transition thereof.

Although durable item carriers such as baskets, totes or carts are effective and useful in enabling users to transport items throughout a materials handling facility, the processes by which users may purchase or otherwise check out such items are presently plagued by physical limitations and delays, in that the items must be removed from the item carrier before being placed in a bag or like container that may be released to the user. Such actions, whether performed by a staff member or a user, necessarily slow the rate at which the user may complete a transaction for the items, or otherwise take control of such items.

Moreover, many bags in which such items may be placed are flimsy and formed from materials having relatively low shear strengths or yield stresses, such as paper or plastic.

DETAILED DESCRIPTION

As is set forth in greater detail below, the present disclosure is directed to combination carrying devices that may be utilized by users in materials handling facilities or like environments. More specifically, the systems and methods disclosed herein include totes or other carrying devices including baskets having rigid structural frames and bags provided within such frames, with a shape and storage capacity corresponding to the frames of the baskets. The carrying devices may be configured such that the bags are folded and held into place or nested within the baskets, which may feature retractable handles mounted along an outer rim of an upper perimeter, thereby enabling the carrying devices to be stacked. The bags may include side panels and end panels, with the side panels having longer dimensions and/or larger areas than the end panels, as well as folded handles that are disposed within an inner rim of the upper perimeter. Users may use the combination carrying devices to transport items within a materials handling facility and, upon completing a picking of items from inventory locations within the materials handling facility, lift the bag by the handles, thereby removing the bag and the items therein from the basket, and carry the bag, and the items, to an intended destination. For example, if the user has retrieved items from one or more inventory locations, and the items are to be transitioned to a packing station or conveyor, the user may lift the bag by the handles, thereby removing the bag and the items from the basket collectively, and transition the bag and the items to a packing station or onto a conveyor as a single unit, rather than removing each item from the basket and transitioning the items to the packing station or onto the conveyor individually.

As used herein, a "materials handling facility" may include, but is not limited to, warehouses, distribution centers, cross-docking facilities, order fulfillment facilities, packaging facilities, shipping facilities, rental facilities, libraries, retail stores or establishments, wholesale stores, museums, or other facilities or combinations of facilities for performing one or more functions of material or inventory handling for any purpose.

Figure 1B:
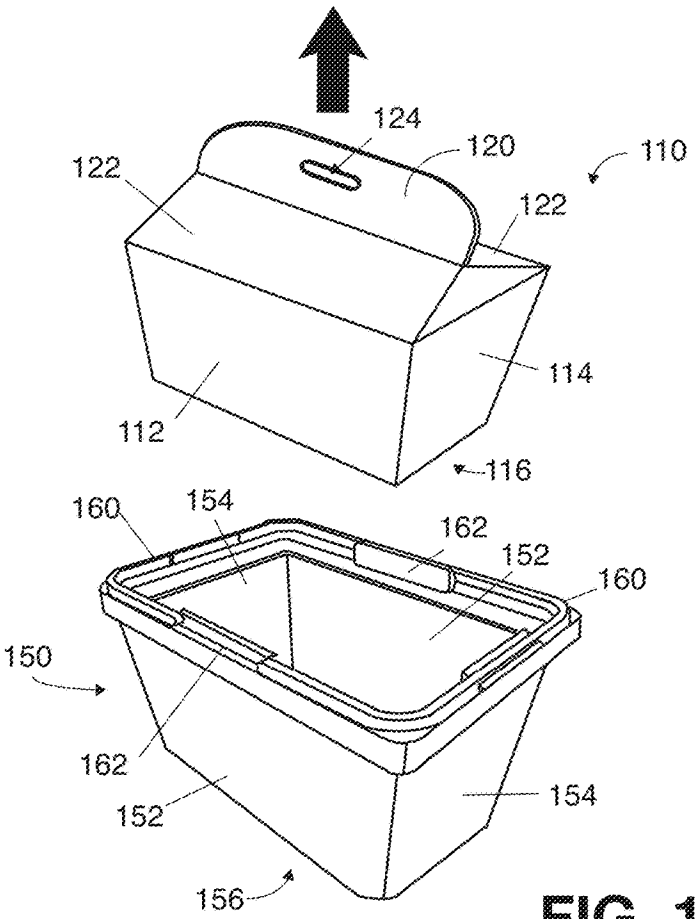
FIGS. 1A and 1B are views of components of one combination carrying device in accordance with implementations of the present disclosure.
Figure 1A:
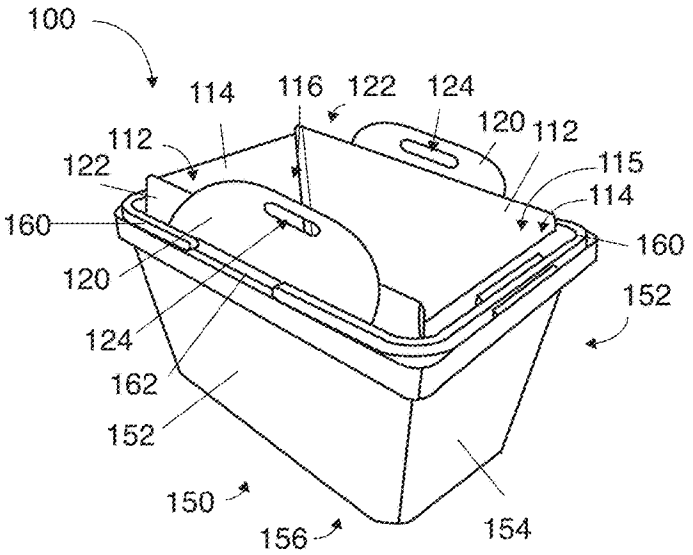

Referring to FIGS. 1A and 1B, a combination carrying device 100 including a bag 110 and a basket 150 is shown. The bag 110 includes a pair of long sides (or side panels) 112, a pair of short sides (or end panels) 114 and a bottom 116. The long sides 112 and the short sides 114 have substantially trapezoidal shapes, and the bottom 116 has a substantially rectangular shape. As is shown in FIGS. 1A and 1B, the long sides 112 have upper edges and lower edges having lengths that are comparatively greater than lengths of corresponding upper edges and lower edges of the short sides 114, and areas that are comparatively larger than areas of the short sides 114.

The long sides 112, the short sides 114 and the bottom 116 define a tapered or frustopyramidal hollow volume 115, e.g., a hollow cavity having a shape corresponding to a frustrum of a pyramid, or a pyramidal frustrum, for receiving one or more items therein. The volume 115 has a substantially rectangular horizontal cross-section with areas of descending size, from top to bottom, beginning with an area defined by upper edges of the long sides 112 and the short sides 114, and concluding with an area of the bottom 116.

Additionally, the bag 110 further includes a pair of handles 120. Each of the pair of handles 120 comprises a handle panel or handle extension joined to one of the long sides 112 by a flap 122 that is formed integrally therewith, and further includes a slot 124 for accommodating one or more hands of a user (not shown).

Like the bag 110, the basket 150 includes a pair of long sides (or end panels) 152, a pair of short sides (or side panels) 154 and a bottom 156 which also define a tapered or frustopyramidal hollow volume 155 corresponding to the tapered or frustopyramidal hollow volume 115 of the bag 110 for receiving the bag 110 and the contents thereof within. The long sides 152 and the short sides 154 have substantially trapezoidal shapes, and the bottom 156 has a substantially rectangular shape. Additionally, and also like the volume 115 of the bag 110, the volume 155 has a substantially rectangular horizontal cross-section with areas of descending size, from top to bottom, beginning with an area defined by upper edges of the long sides 152 and the short sides 154, and concluding with an area of the bottom 156. Alternatively, the volume 155 may have a corresponding frustoconical volume, e.g., a hollow cavity having a tapered shape corresponding to a frustrum of a cone, or a conic frustrum, or any other tapered volume having any cross-sectional shapes or areas and one or more continuous surfaces, such as ellipses, circles or other regular or irregular shapes. Moreover, the volume 155 may be formed from sides or panels having substantially equal lengths, e.g., with square cross-sections, such that none of the sides is longer or shorter than another, or that none of the panels constitutes either a side or an end of the volume 155.

As is shown in FIG. 1A, the bag 110 and the basket 150 have corresponding tapered or frustopyramidal shapes. For example, the various internal and external angles of the bag 110, e.g., the angles formed by the joining of the planar sections of the long sides 112, the short sides 114, and the bottom 116 of the bag 110, are substantially equal to the angles formed by the joining of the planar sections of the long sides 152, the short sides 154 and the bottom 156 of the basket 150. Accordingly, as is shown in FIG. 1A, the bag 110 may be nested within the basket 150 in a manner that causes the bag 110 to remain in place, such as by creasing portions of the handles 120 along the long sides 112 of the bag 110, and inserting the creased portions of the handles 120 between the long sides 112 of the bag 110 and the long sides 152 of the basket 150, thereby providing at least a nominal force of friction to resist either an unintended removal of the bag 110 from the basket 150, or an undesired collapse of the bag 110 into the basket 150, during normal use of the combination carrying device 100.

As is shown in FIG. 1B, when a user desires to remove the bag 110 and any items therein from the basket 150, the user may place one or more hands within the slots 124, and lift each of the handles 120, thereby extracting the bag 110 from the basket 150, while maintaining much of the structural integrity of the volume 115 of the bag 110.

Accordingly, the combination carrying devices of the present disclosure, including but not limited to the combination carrying device 100 of FIGS. 1A and 1B, may include bags or other like soft, flexible item carriers and baskets or other like firm, rigid item carriers, with the bags having external shapes and dimensions that are specifically selected to conform to interior shapes and dimensions of the baskets, such that the bags may be received within the baskets and maintained in place there. For example, the bags may be formed in tapered shapes having internal angles and external angles or other features that are substantially equal to their counterpart internal angles and external angles or other features of baskets, and include one or more dimensions that are slightly smaller than their counterpart dimensions of baskets, such that the bags may be simply and releasably nested within such baskets. The combination carrying devices thereby effectively join two carriers that are traditionally recognized as separate components, namely, a basket and a bag, in a manner that allows a user to seamlessly transition between exploiting the advantages of a basket, e.g., the strength and durability thereof, and the advantages of a bag, e.g., its portability and lightweight structure. The combination carrying devices further enable users to eliminate the requirement to transition picked items from a carrier or cart into a bag (e.g., when transitioning from picking to packing, or at a checkout station of a retail establishment), when the items to be transitioned are located in a basket, as the items are already placed within a volume of a bag that is releasably provided within a volume of the basket.

In accordance with the present disclosure, bags may be formed from flexible materials that define a cavity for receiving one or more objects therein, and may include handles extending from flaps provided along at least one side of the bags which enable the bags to be removed from the baskets, with the objects therein, when the items are to be transitioned from one state to another. According to some implementations, the handles may constitute substantially planar elements defined by chords, bases or segments which are connected to one or more flaps extending along opposing lengths of the bags. According to some other implementations, the bags may include pairs of straps or strap-like handles corresponding to different uses thereof. For example, a bag may include a pair of handles on opposing sides thereof, including a pair of long handles for carrying the bag about a shoulder or forearm, and a pair of short handles for carrying the bag by hand or for removing the bag from a basket in which the bag is nested. The handles of the present disclosure may include reinforcement stitching in selected locations thereof, including about all or a portion of a perimeter of an opening for a hand, arm or shoulder, or along all or a portion of a length of a strap.

Using one or more of the carrying devices disclosed herein, items may be transitioned from picking to packing, or from picking to a conveyor, at the conclusion of a working or shopping experience, or at another appropriate time. The baskets may be formed from one or more durable materials, and may be configured to receive and maintain the bags in place therein. Additionally, the baskets may be provided with two or more handles mounted along and outside of an upper perimeter, such that the handles do not interfere with the insertion or removal of the bags, and enable the baskets to be stored in a stack or other like arrangement, with bags interleaved therein.

For example, the bags may be formed from any type or form of flexible materials, e.g., one or more panels of such materials, including but not limited to knitted, woven or non-woven fabrics, natural or synthetic leathers or canvases, or other like materials that may be joined at one or more edges thereof, such as by stitching. Preferably, the materials from which the bags are formed are sufficiently structurally sound such that the bags remain erect even after the bags have been removed from their respective baskets, and are yet flexible enough to be folded and deposited within the baskets in a manner that causes the bags to be held in place therein. Additionally, the bags are preferably formed with rectangular cross sections and in tapered, frustopyramidal shapes that conform to interior volumes of the baskets in which the bags are placed.

In some implementations, the bags may be formed from one or more panels of fibrous fabrics that are formed at least in part from paper, cotton or recycled plastics, including but not limited to fabrics comprising blends of cotton or like natural materials and materials comprising recycled plastics, thereby providing the bags with enhanced hydrophobicity to repel liquids or other stain-forming matter. For example, in some implementations, the bags may be formed from non-woven plastic polypropylene materials, while in other implementations, the bags may be formed from woven fabrics including polypropylene or polyethylene fibers. Moreover, the bags may be formed from materials that are laminated on one or both sides thereof, and such materials from which the bags are formed may be selected on any basis. Laminating or otherwise reinforcing or protecting such materials enables the bags to be used, washed and reused on several occasions. For example, where the bags disclosed herein are intended to be reused by customers who received them from a retail establishment, or by the retail establishment that furnished the bags to the customers, such materials may selected based on their durability and capacity to withstand repetitive cleaning and reuse in a variety of environments.

The bags may also include handles provided on long sides thereof, within polygonal shapes or flaps extending along all or a portion of the long sides of the bag. Such shapes or flaps ensure that tensile forces provided by a customer who is holding a bag from above, by the handles, are evenly distributed throughout the length of the bag, and not concentrated about one or more likely points of failure. The handles may include one or more slots defined by elongated holes that are aligned substantially parallel to the long sides of the bag. Such slots may be may be reinforced, as necessary, with perimeter stitching.

In accordance with the present disclosure, baskets may be formed in tapered, frustopyramidal shapes corresponding to such tapered, frustopyramidal shapes of the bags provided therein, and from plastic, wood, metal or other durable materials that provide structural support and orientation of bags and the contents thereof. For example, the baskets may be formed from one or more types of thermoplastics or thermosetting plastics such as epoxy or phenolic resins, polyurethanes or polyesters, as well as polyethylenes, polypropylenes or polyvinyl chlorides, or acrylonitrile butadiene styrenes. Alternatively, the baskets may be formed from one or more recycled plastics, bioplastics, cellulose or compostable plastics, natural plastics, or any other like materials.

In some implementations, the baskets may be substantially solid, e.g., without holes or other perforations therein. In some other implementations, however, the baskets may be provided with slots or holes, in a regular or irregular lattice or other arrangement. Additionally, the baskets may include two or more handles that are provided on an upper perimeter and mounted to exterior surfaces thereof. According to some implementations, a pair of handles, each having lengths corresponding approximately to half of the upper perimeter may be mounted to central points about the upper perimeter with pivotable or rotatable connections, such that that ends of the handles may pivot or rotate about such points from a lowered position along the upper perimeter to a raised position where the ends may be joined above the baskets. Such handles may include one or more ergonomically designed features that are provided in order to enhance the comfort of a user who is transporting a combination carrying device using his or her hands or arms, such as perpendicular joints having rounded shapes.

According to some implementations, the handles may be mounted on outer surfaces of a basket, and provided about an upper perimeter of the basket, in a manner that enables each of the handles to pivot or rotate from a first position that closely conforms to the upper perimeter of the basket to a second position where the handles are joined above or about a center of the basket. Moreover, according to some other implementations, an upper perimeter of a basket may include a shelf or other rounded extension supported by one or more corbels or other supports provided at regular or irregular intervals of the upper perimeter.

Additionally, the upper perimeter of the basket may include a central area along the long sides thereof having a tapered section with a reduced height or elevation. One or more handles may be mounted to outer surfaces of the basket at the central area, and may be provided in obtuse angles, such that the handles closely conform to the upper perimeter thereof in the first position, and may rotate upward to the second position. The long sides of the basket may include an angled mounting bore that is formed integral to the tapered, frustopyramidal shapes of the baskets (e.g., by injection molding or one or more other means), but includes one or more faces that are oriented substantially vertically and permit the handles to rotate from the first position to the second position within a substantially vertical plane. Moreover, in some implementations, the external faces of the long sides may include one or more mechanical stops (e.g., pegs or other extensions) associated with each of the handles which prevent such handles from pivoting or rotating a predetermined extent, e.g., a predefined angle, beyond the second position.

According to some implementations, the baskets of the present disclosure may include pivotable or rotatable handles formed of rounded and/or smoothed metals, plastics, composites or other like materials. The handles may include relatively thick or rigid portions corresponding to ends or extensions by which such handles are mounted or joined to a tapered basket, and comparatively thinner portions corresponding to regions that are intended for gripping by one or more users thereof. Additionally, the handles may also have lengths which correspond to portions of the upper perimeters of the baskets, as well as portions which extend beyond or outside of the upper perimeters.

The rotatable or pivotable handles may further include mechanical stops or extensions having one or more planar components that are aligned to come into contact with one or more surfaces of an upper perimeter of a basket. The mechanical stops or extensions may include single planar components for contacting a single edge of an upper perimeter of a basket, or multiple planar components for contacting multiple edges of the upper perimeter of the basket. Moreover, depending on their positioning on the handles and the extent to which the handles may rotate or pivot, the mechanical stops or extensions may restrict the rotation of the handles between a first position closely conforming to an upper perimeter of a basket to a second position at which the handles are joined above or about a center of the basket.

According to some other implementations, the baskets of the present disclosure may further include one or more handles that are formed by cuts into one or more sides of the baskets, e.g., slots provided on corresponding sides, such as on two short sides or two long sides of the baskets. Such slots enable a user to manipulate a basket without requiring the use of one or more pivotable or rotatable handles mounted thereon.

According to still other implementations, the baskets disclosed herein may include one or more slots or other openings configured to receive tabs or extensions of bags that are nested therein. The slots or openings may be provided near or about the upper perimeters of such baskets, or integrated into one or more sides or corners of such baskets. In some implementations, the shapes of such slots or openings may include substantially narrow necks with widths that are selected as a function of the materials from which the tabs or extensions are formed, or one or more attributes of such tabs or extensions (e.g., one or more dimensions thereof). For example, a bag having a tab or extension formed from a substantially durable material such as canvas, vinyl, leather or nylon may be nested into a basket having one or more of such slots or openings by sliding the tab or extension through a neck thereof. The materials or dimensions of the tab or extension, and the materials or dimensions of the neck or the slot or opening, may be selected based on their respective compressibility and static or dynamic friction properties in accordance with the present disclosure.

Moreover, in some implementations, the baskets may also include perforated or latticed sides, corners, bottoms or other elements. The slots or openings for receiving tabs or extensions of bags therein may comprise or be consistent with one or more of the openings within such perforated or latticed elements, or may be provided independent or apart from such elements.

The tapered, frustopyramidal shapes of the baskets, and the mounting of the handles along exterior surfaces thereof, enable combination carrying devices including such baskets to be stacked with or without bags provided therein. For example, two or more combination carrying devices having bags disposed in baskets may be stacked with the devices oriented upwardly, e.g., with openings of the volumes defined by such bags and baskets aligned in a vertically upward manner, such as is shown in the combination carrying device 100 of FIG. 1A, near an entrance to a materials handling facility. Users may retrieve one of the combination carrying devices upon arriving at the materials handling facility, and may travel throughout the materials handling facility to search for items of interest, and place one or more of such items within a bag provided within a basket. When the user has completed a picking of the items, the user may remove the bag from the basket, and stack the basket near an exit of the materials handling facility, e.g., in a downward orientation, with the openings of the volumes defined by the basket aligned in a vertically downward manner.

The rotatable or pivotable handles and the baskets may also include sections or components which cause the handles of a basket to automatically rotate or pivot from a first position closely conforming to an upper perimeter of the basket to a second position at which the handles are joined above or about a center of the basket. In some implementations, when a first basket is stacked within a second basket, and the first basket is lifted therefrom, a magnet or magnetized section of a handle of the first basket is magnetically drawn to a corresponding magnet or magnetized section of a surface of the second basket, thereby causing the handle to remain in contact with the second basket until the second basket is lifted and removed from the first basket entirely. Thus, the handles of the second basket are in a position to be grasped by a user, and pulled up from a third basket, or any further baskets, that may be provided in a stack beneath the second basket, even when the baskets include bags nested therein.

Additionally, in some implementations, the baskets may further include slits, clips or other features, or combinations of features, that are designed to correspond with one or more pockets, tabs or other features, or combinations of features, of bags and aligned to nest a bag in place therein. When a bag is nested within a basket, such features ensure that the bag may not be removed from the basket without further manual interaction that releases the edges from beneath such features. For example, according to some implementations, a bag may include a pocket or other open portion provided along one or more of the outer sides thereof, and a basket may include one or more hooks or other features provided along one or more of the inner sides thereof for receiving at least the pocket or another portion of the bag therein. The bag may be releasably nested within the basket when at least a portion of a pocket is received within a hook, e.g., between at least a portion of the hook and the inner surface on which the hook is provided.

Alternatively, according to some other implementations, a bag may include one or more stitched tabs or extensions provided along an outer surface thereof, e.g., at one or more corners defined by an intersection between two or more of the panels thereof. The stitched tabs or extensions may include narrow sections for joining the tabs or extensions to the outer surface of the bag, and broader sections at distal ends thereof, with such broader sections formed by folds, turns or knots of fabric or other like material. The baskets may include slots provided along inner or outer surfaces thereof, e.g., at one or more corners defined by an intersection between two or more of the panels thereof, with such slots sized to accommodate at least a portion of the tabs or extensions therein.

In this regard, such features may ensure that when a plurality of the combination carrying devices are provided in a stack, a pocket of the bag may be provided within a hook of the basket, or a tab of the bag may be slid into a slot of the basket, thereby causing the bag to remain nested within the basket when a customer retrieves one of the combination carrying devices from the stack. When the bag is releasably nested within the basket, e.g., by way of a hook-and-pocket combination, or a tab-and-slot combination, the bag will not remain attached to a basket provided beneath the combination carrying device in the stack. Such features thereby maintain the bag releasably nested within the basket, and also ensure that the bag does not collapse within the basket.

Moreover, the baskets may also include clips or similar features which lock the baskets together when such baskets are stacked without bags nested therein, yet do not lock the baskets together when such baskets are stacked with bags nested therein. Such clips or other features permit baskets that are nested with bags to be stacked in an unlocked or removable configuration, while locking baskets that do not include bags in a fixed configuration. Thus, baskets that are nested with bags may be placed alongside baskets which lack bags near an entrance or an exit to a materials handling facility in separate stacks, enabling users to retrieve baskets that are nested with bags from one of the stacks, but preventing users from retrieving baskets which lack bags from the other of the stacks.

Additional features and advantages of the combination carrying devices, and the bags or baskets associated therewith, are set forth in greater detail below.

Figure 2B:
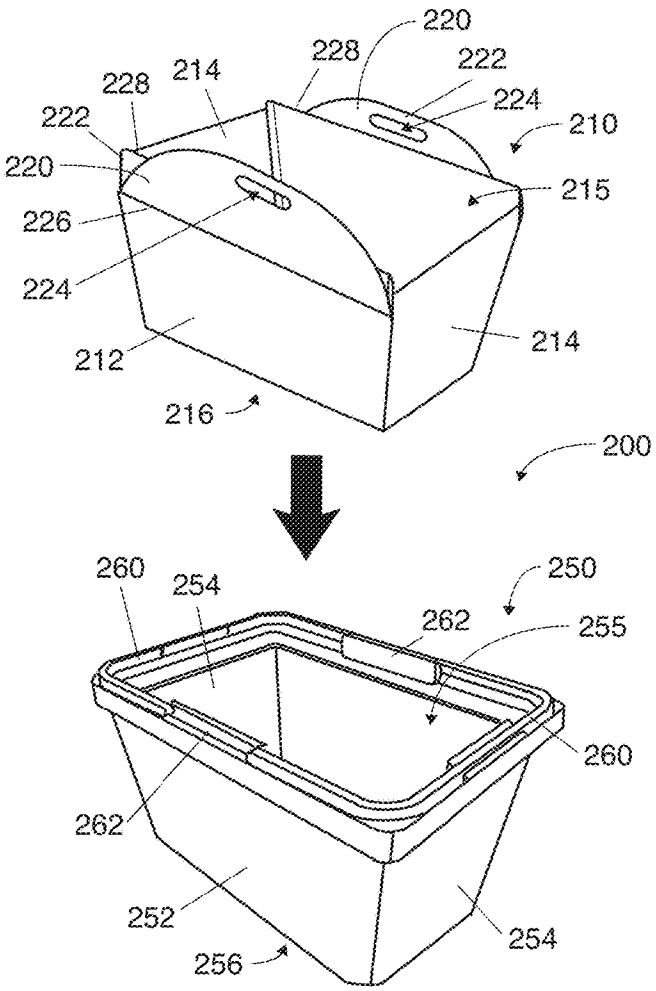
FIGS. 2A and 2B are views of one bag provided for use in a combination carrying device in accordance with implementations of the present disclosure.
Figure 2A:
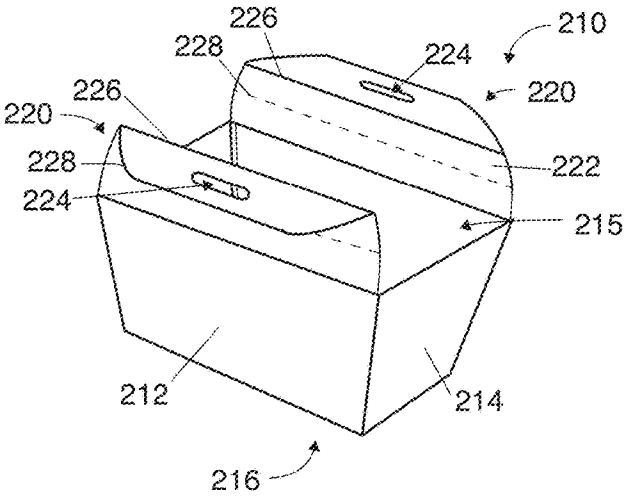

Referring to FIGS. 2A and 2B, one example of a bag 210 that may be provided for use in one or more combination carrying devices of the present disclosure is shown. Except where otherwise noted, reference numerals preceded by the number "2" shown in FIG. 2A or 2B indicate components or features that are similar to components or features having reference numerals preceded by the number "1" shown in FIGS. 1A and 1B.

As is shown in FIG. 2A, the bag 210 includes a pair of long sides 212, a pair of short sides 214 and a bottom 216. The long sides 212 and the short sides 214 extend vertically upward from the bottom 216, and define a tapered volume 215. Additionally, the bag 210 further includes a pair of handles 220, with each handle 220 being joined to an upper edge of one of the long sides 212 by a flap 222. Each of the handles 220 further includes a slot 224 having a size and orientation for accommodating a hand therein. Each of the handles 220 is shown as having a crease 226 at which the handle 220 is flexibly folded or bent, as well as a scored line 228 that may accommodate one or more creases when the bag 210 is folded for insertion into a corresponding basket.

Referring to FIG. 2B, a combination carrying device 200 including the bag 210 of FIG. 2A and a basket 250 is shown. Each of the handles 220 of the bag 210 is twice folded such that the bag 210 may be releasably nested within a volume 255 of the basket 250. For example, the handles 220 are folded twice, including first about the crease 226 and second along the scored line 228. In the folded configuration shown in FIG. 2B, the bag 210 may be inserted into the volume 255 of the basket 250, and the combination carrying device 200, including both the bag 210 and the basket 250, may be provided to a user at a materials handling facility. The user may place one or more items within the volume 215 of the bag 210 and, after completing a transaction for the purchase of the items, lift the bag 210 from the basket 250 by placing his or her hands within the slots 224 and raising the bag 210 and the items therein by the handles 220, such as is shown with regard to the bag 110 of FIG. 1B.

Those of ordinary skill in the pertinent arts will recognize that the bags provided in the combination carrying devices of the present disclosure may be formed from any number of panels of appropriate fabric-based materials, including one or more knitted, woven or non-woven fabrics, as well as natural or synthetic leathers, canvases or other like materials. Such materials may be stitched together at appropriate locations to form one or more seams. As is discussed above, the bags may include handles formed from one or more polygonal or rounded shapes, rather than in a substantially linear fashion, thereby enhancing the strength of the handles at one or more anticipated failure points along slot perimeters, and distributing forces associated with lifting and carrying such bags along one or more lengths thereof. Additionally, reinforcement stitches may be provided, where necessary, to enhance the durability and survivability of such bags during and after use thereof.

Figure 3B:
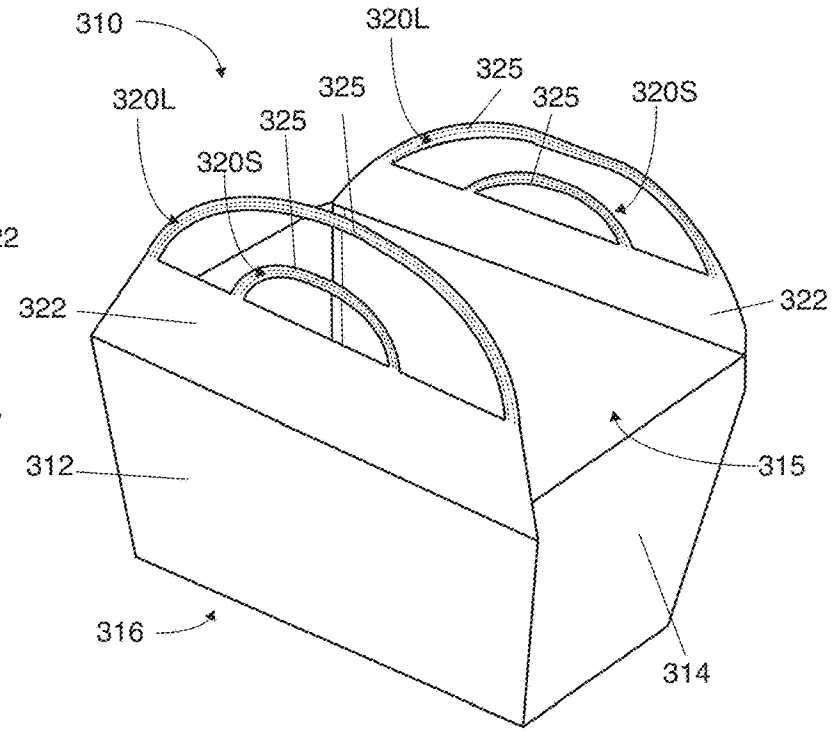
FIGS. 3A and 3B are views of one bag provided for use in a combination carrying device in accordance with implementations of the present disclosure.
Figure 3A:
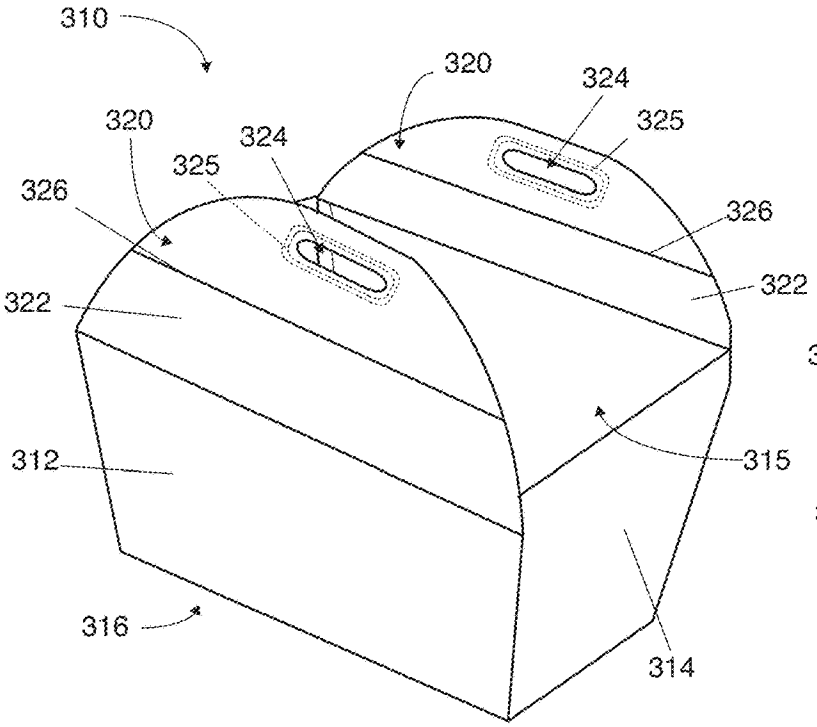

Referring to FIGS. 3A and 3B, implementations of bags 300 of the present disclosure are shown. Except where otherwise noted, reference numerals preceded by the number "3" shown in FIG. 3A or FIG. 3B indicate components or features that are similar to components or features having reference numerals preceded by the number "2" shown in FIG. 2A or 2B, or by the number "1" shown in FIGS. 1A and 1B.

As is shown in FIG. 3A, the bag 300 includes a pair of long sides 312, a pair of short sides 314 and a bottom 316 defining a volume 315. The long sides 312, the short sides 314 and/or the bottom 316 may be formed from a common material, or joined by stitching or any other manner at one or more seams. The bag 300 further includes a pair of handles 320 extend from flaps 322 that are joined at upper portions of the long sides 312. The handles 320 include slots 324 for accommodating one or more fingers of hands therein, as well as creases 326 for enabling the handles 320 to be folded easily when nesting the bag 310 within a basket (not shown). Additionally, as is shown in FIG. 3A, the slots 324 further include double reinforcement stitching stitches 325 along a perimeter thereof, to provide reinforcement against shear forces associated with the lifting and carrying of the bag 310. Those of ordinary skill in the pertinent arts will recognize that any type or form of reinforcement may be provided to the slots 324 of the handles 320, in addition to reinforcement stitching, or to any other portion or region of the handles 320, the flaps 322 or the slots 324.

As is further shown in FIG. 3A, the handles 320 are each formed in substantially hemispheric (e.g., semicircular) shapes, and extend from or are joined at a chord corresponding to an upper edge of each of the long sides 312. The hemispheric shapes of the handles 320 ensure that forces provided by users who grip the bag 310 at the slots 324 will be evenly distributed along the long sides 312 of the bag 310, and not concentrated immediately beneath the handles 320, about a midpoint thereof. Thus, the even distribution of such forces aids in maintaining the structural integrity of the bag 310 and the volume 315, and in preserving the orientation and/or alignment of any items provided therein.

Although the handles 320 of FIG. 3A are formed in substantially hemispheric shapes, those of ordinary skill in the pertinent arts will recognize that such handles may be formed of any substantially planar shape having an edge that may be joined to an upper edge of the one of the long sides 312. Some such shapes may include, but are not limited to, rectangles, triangles, trapezoids or the like. For example, handle extensions or handle panels of the present disclosure may be formed in the shape of a trapezoid having a base joined to an upper edge of a long side or side panel. Alternatively, the handle extensions or handle panels may be formed in the shapes of circular, elliptical or parabolic sectors defining arcs and chords or segments that are also joined to the upper edge of the long side or side panel.

As is discussed above, the bags of the present disclosure may include any number of handles of any type or form, including one or more planar handles, such as is shown in FIG. 3A, or one or more straps or strap-like handles. As is shown in FIG. 3B, the bag 300 includes a pair of long handles 320L and a pair of short handles 320S provided on the opposing long sides 312 thereof. As is shown in FIG. 3B, the pairs of long handles 320L and the pairs of short handles 320S are formed from straps provided in substantially equal lengths on the opposing long sides 312, and are reinforced by double reinforcement stitching 325. The pairs of long handles 320L or the pairs of short handles 320S may be formed from and integral to the same common material as the long sides 312, the short sides 314 or the bottom 316, or formed from different materials, or discrete pieces of materials, that are joined to one or more of the long sides 312 or the short side 314 in any manner, e.g., by stitching, staples or adhesives, or a combination of stitching, staples or adhesives.

The bags of the present disclosure, such as the bag 310 of FIG. 3B, may be provided with a variety of handles for different purposes. For example, the long handles 320L of the bag 310 of FIG. 3B may be provided to enable a user to carry the bag 310 using his or her shoulders or forearms, e.g., after the bag 310 and any items therein have been extracted from a basket, such as at the conclusion of any picking or shopping experience. The short handles 320S of the bag 310 of FIG. 3B, meanwhile, may be provided to enable a user to extract the bag 310 and any items therein from a basket, or to carry the bag 310 and any items herein using his or her hands.

Although the pairs of long handles 320L and the pairs of short handles 320S are substantially semicircular in shape, those of ordinary skill in the pertinent arts will recognize that straps or strap-like handles, such as the long handles 320L or the short handles 320S of FIG. 3B, may be provided in any shape, including continuous arcs such as portions of circles, parabolas or ellipses, as well as discontinuous shapes such as portions of squares, rectangles or triangles. Additionally, those of ordinary skill in the pertinent arts will recognize that straps or strap-like handles such as the long handles 320L or the short handles 320S may be folded in the same manner as the handles 320 of FIG. 3A, e.g., in order to enable the bag 310 of FIG. 3B to be releasably nested within a basket. Also, those of ordinary skill in the pertinent arts will further recognize that the bags of the present disclosure need not include handles of identical or similar shapes or sizes. For example, in some implementations, a bag may include one or more substantially planar handles, such as the handle 320 of the bag 310 of FIG. 3A, in combination with one or more straps or strap-like handles, such as the long handles 320L or the short handles 320S of the bag 310 of FIG. 3B.

Figure 4A:
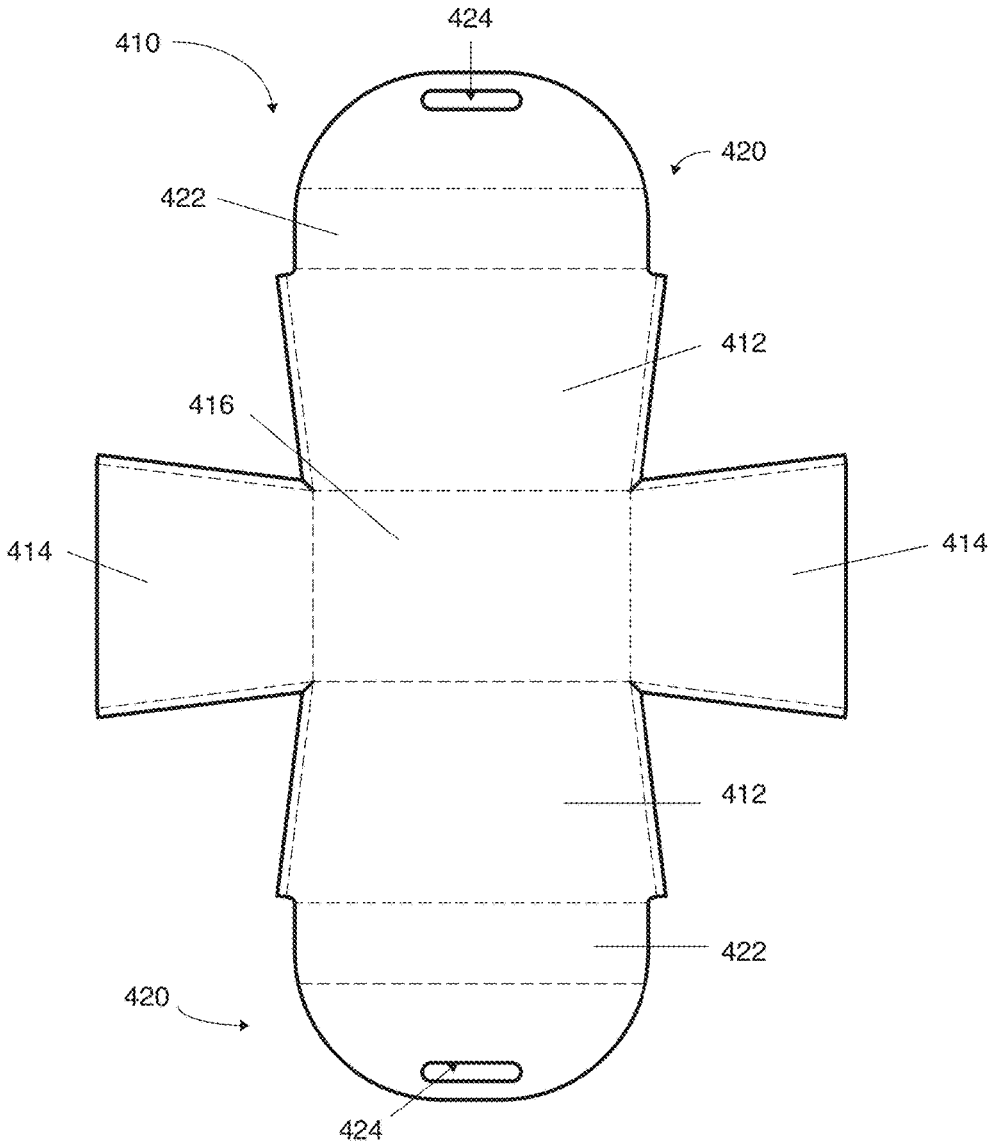
FIGS. 4A and 4B are views of one component of one bag provided for use in a combination carrying device in accordance with implementations of the present disclosure.
Figure 4B:
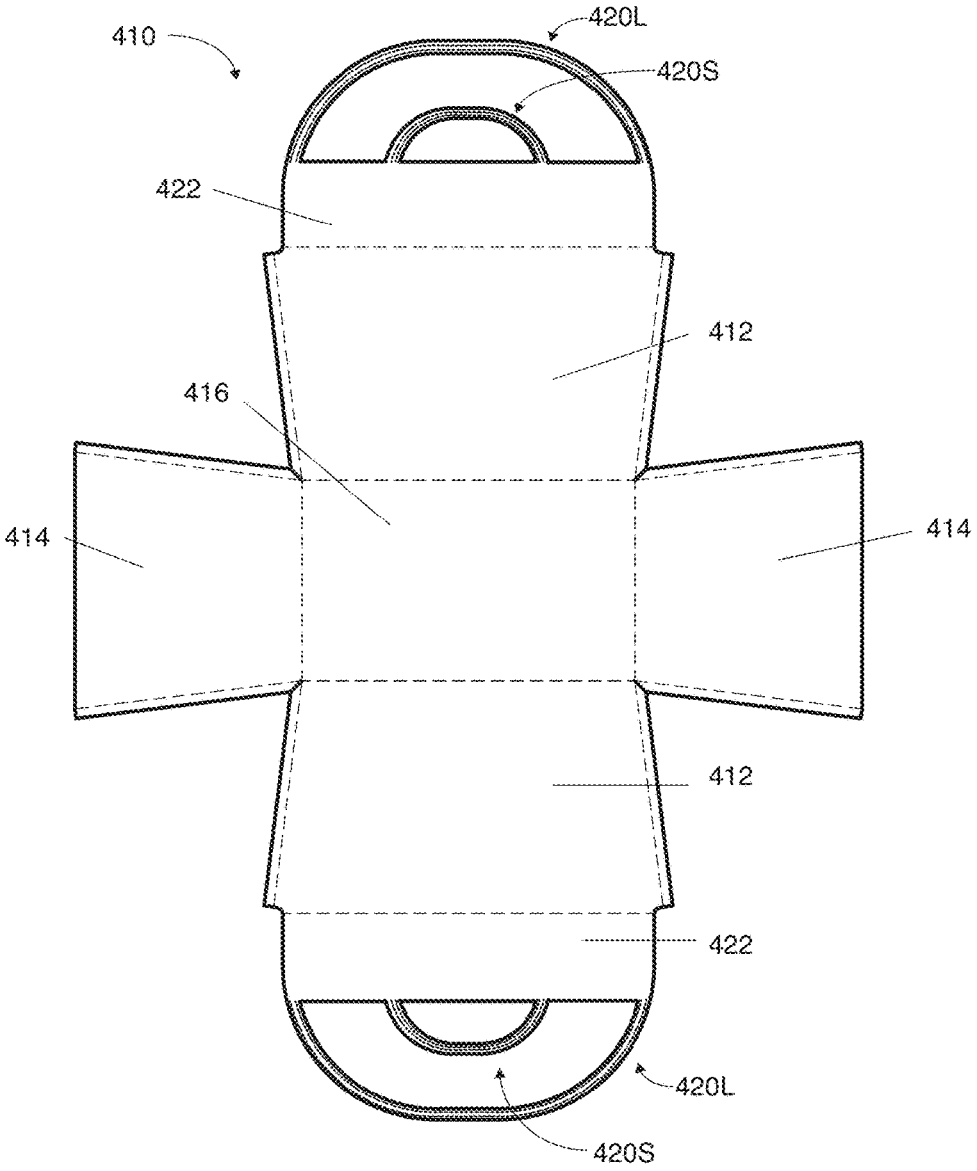

According to some implementations of the present disclosure, the bags may be formed in a single-piece construction from a piece of fabric that is properly cut and shaped, and may be subsequently stitched or joined in order to define a volume that corresponds to an interior of a basket and may be nested therein. Referring to FIGS. 4A and 4B, single pieces 410 of fabric are shown. Except where otherwise noted, reference numerals preceded by the number "4" shown in FIG. 4 indicate components or features that are similar to components or features having reference numerals preceded by the number "3" shown in FIG. 3, by the number "2" shown in FIG. 2A or 2B, or by the number "1" shown in FIGS. 1A and 1B.

As is shown in FIG. 4A, the single piece 410 of fabric corresponds to a bag such as the bag 310 of FIG. 3A. The single piece 410 of FIG. 4A includes each of the facets and features of the bag 310 of FIG. 3A and may be provided in one or more of the combination carrying devices disclosed herein. For example, the single piece 410 includes panels or subsections corresponding to sides and a bottom of such a bag, including subsections 412 corresponding to long sides of the bag, subsections 414 corresponding to short sides of the bag and a subsection 416 corresponding to a bottom of the bag. When the subsections 414, 416 are joined together at their respective sides, e.g., by stitching, gluing, bonding or the like, using one or more adhesives, the single piece 410 of fabric will define a volume, such as the volume 115 of the bag 110 of FIG. 1A, that may be nested within a basket, such as the basket 150 of FIG. 1A, and accommodate one or more items therein.

Additionally, as is also shown in FIG. 4A, the single piece 410 of fabric also includes a pair of substantially semicircular planar subsections 420 corresponding to handles which include flaps 422 and are joined to the subsections 412 corresponding to long sides. The subsections 420 further include slots 424 provided near an outer perimeter of the subsections 420, which may be used as handles when a bag is formed from the single piece 410 of fabric.

As is shown in FIG. 4B, the single piece 410 of fabric corresponds to a bag, such as the bag 310 of FIG. 3B. Like the single piece 410 of fabric of FIG. 4A, the single piece 410 of fabric of FIG. 4B includes each of the facets and features of the bag 310 of FIG. 3B and may be provided in one or more of the combination carrying devices disclosed herein. Like those of the single piece 410 of FIG. 4A, the panels or subsections 412, 414, 416 of the single piece 410 of FIG. 4B may be joined at their respective sides to define a volume, such as the volume 115 of FIG. 1A, that may be nested within a basket, such as the basket 150 of FIG. 1A, and accommodate one or more items therein.

Additionally, as is also shown in FIG. 4B, the single piece 410 of fabric also includes a pair of substantially semicircular straps or strap-like long subsections 420L and a pair of substantially semicircular straps or strap-like short subsections 420S which include flaps 422 and are joined to the subsections 412 corresponding to the long sides. In accordance with the present disclosure, the single pieces 410 of fabric from which bags may be formed may include straps or strap-like handles of any length, shape or thickness, and need not be limited to the lengths, shapes or thicknesses of the long subsections 420L or the short subsections 420S shown in FIG. 4B.

Forming a bag from a single piece of fabric, such as the single pieces 410 of FIG. 4A or FIG. 4B, provides a number of advantages over prior art materials and methods. For example, referring again to FIG. 4A, a bag may be assembled by cutting the single piece 410 including subsections corresponding to the various facets or features of the bag from a larger piece of fabric, joining the subsections 412, 414 at four pairs of edges that are adjacent to one another, and defining the handles from the subsections 420. Next, the most critical boundaries of the bag, e.g., the edges between the respective long sides and short sides thereof, may be reinforced by stitching or other means, thereby enhancing the structural strength thereof.

Those of ordinary skill in the pertinent arts will recognize, however, that the bags of the present disclosure may be formed from any number of pieces of fabric or other sufficiently strong materials, and are not limited to construction from single pieces, such as the single pieces 410 of FIG. 4A or FIG. 4B.

As is discussed above, the combination carrying devices of the present disclosure include baskets formed from suitably durable materials which have shapes and volumes corresponding to a bag, such as one of the bags 110, 210, 310 of FIG. 1A, 1B, 2A, 2B or 3, and are configured to receive and nest one or more of such bags therein. Referring to FIGS. 5A, 5B, 5C and 5D, one implementation of a basket 550 in accordance with the present disclosure is shown. Except where otherwise noted, reference numerals preceded by the number "5" shown in FIG. 5A, FIG. 5B, FIG. 5C or FIG. 5D indicate components or features that are similar to components or features having reference numerals preceded by the number "2" shown in FIG. 2B, or by the number "1" shown in FIGS. 1A and 1B.

Figure 5B:
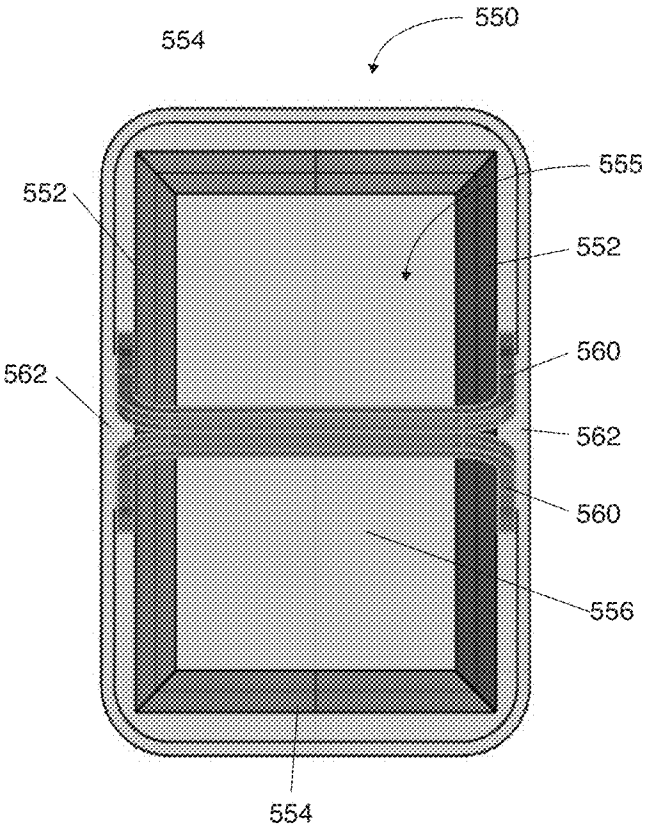
FIGS. 5A, 5B, 5C and 5D are views of one basket provided for use in a combination carrying device in accordance with the present disclosure.
Figure 5A:
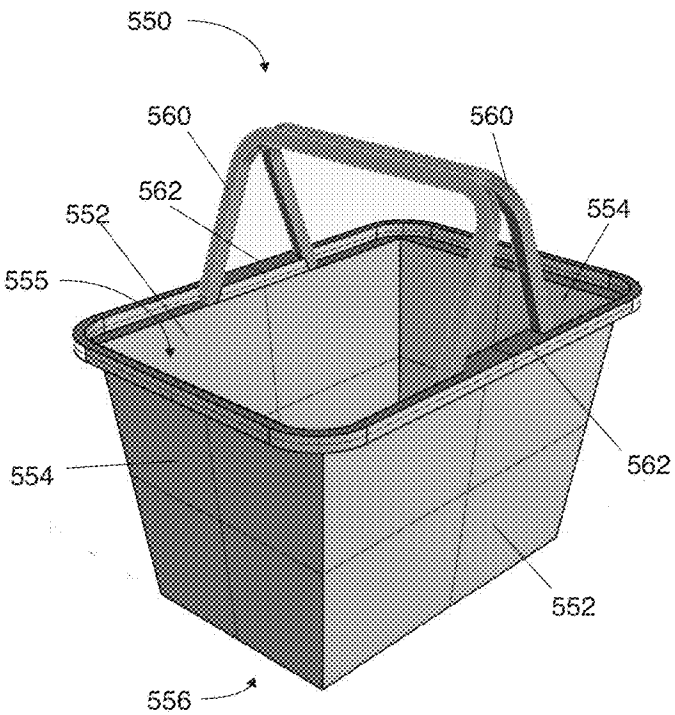

Referring to FIG. 5A, a perspective view of the basket 550 is shown. The basket 550 is formed from a pair of long sides 552, a pair of short sides 554 and a bottom 556 that are integrally joined as a single unit and define a tapered volume 555. The basket 550 further includes a pair of handles 560, each of which is rotatably mounted at a central mount 562 provided at an upper edge of one of the long sides 552 and along an upper perimeter of the volume 555. In sum, the lengths of the handles 560 and the central mounts 562 generally correspond to the length of the upper perimeter of the volume 555, such that when the handles are rotated outwardly and downwardly, the handles 560 will rest atop the upper perimeter and define a uniform surface above and about the volume 555. The long sides 552, the short sides 554 and the bottom 556 may be formed from a single piece of molded plastic. In other implementations, the basket 550 may be formed from multiple pieces of plastic or any other suitable material.

Moreover, although the long sides 552, the short sides 554 and the bottom 556 are shown in FIG. 5A as substantially solid, those of ordinary skill in the pertinent arts will further recognize that one or more of the long sides 552, the short sides 554 or the bottom 556 may be formed from materials having one or more holes, slots or other perforations which may still accommodate one or more bags (not shown) nested therein, and also provide sufficient structural support for such bags and any contents thereof. Additionally, although the volume 555 of the basket 550 of FIG. 5A is shown as having a substantially frustopyramidal shape, those of ordinary skill in the pertinent arts will also recognize that the combination carrying devices of the present disclosure may feature volumes of any shape, and may be configured to receive and nest bags having volumes which correspond to such shapes.

Figure 5D:
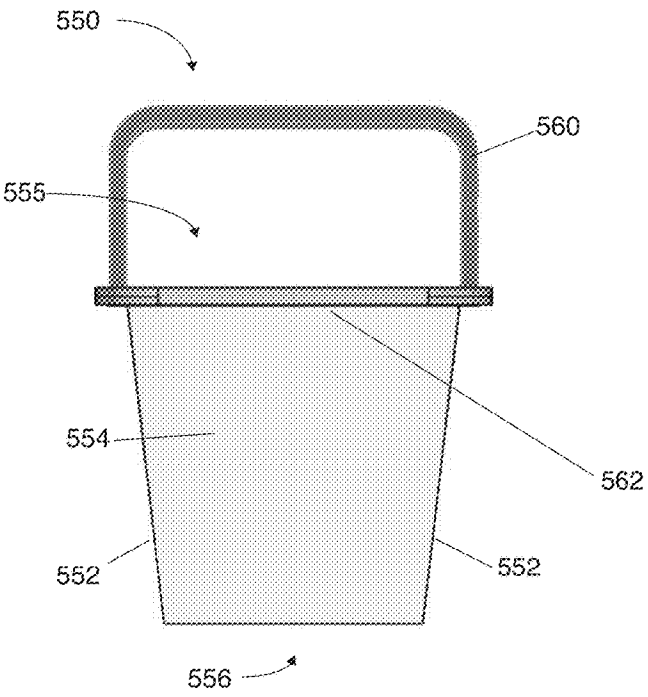
Figure 5C:
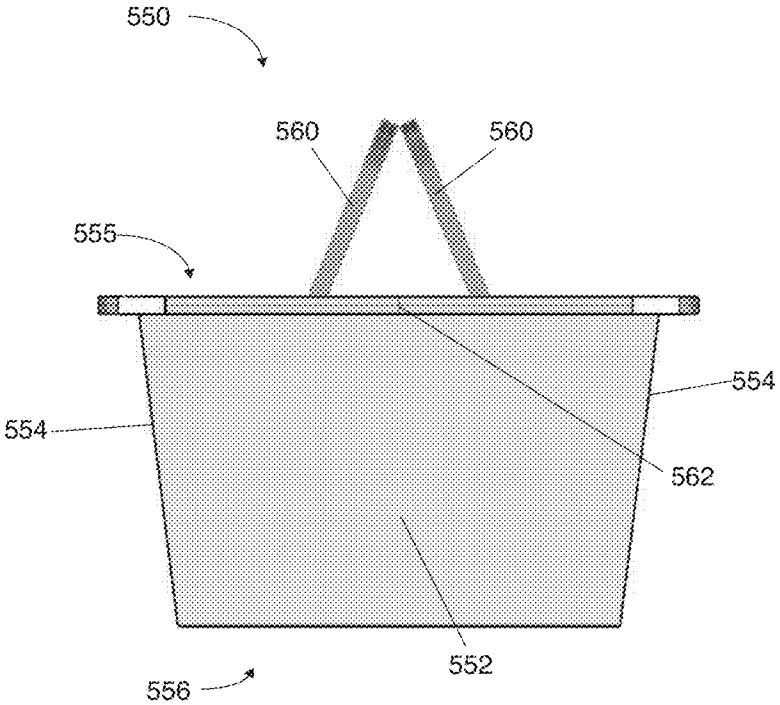

Referring to FIGS. 5B, 5C and 5D, a top view, a front view and a side view of the basket 550 of FIG. 5A, respectively, are shown. The top view of the basket 550 shown in FIG. 5B represents the shape and construction of the volume 555 of the basket 550, and reflects the tapered construction of the long sides 552, the short sides 554 and the bottom 556. Additionally, the top view of the basket 550 of FIG. 5B shows the shape of the upper perimeter of the basket 550 with respect to the shape of the handles 560 as shown in FIG. 5A. The front view and side view of the basket 550 of FIG. 5C and FIG. 5D shows the sizes of the long sides 552 and the short sides 554 with respect to one another. Additionally, the front view and side view of the basket 550 of FIG. 5C and FIG. 5D also show the angular orientation of the handles 560 when the handles 560 are raised atop the upper perimeter of the volume 555.

Furthermore, the perspective view and the side view of the basket 550 in FIGS. 5A and 5D also depict the shapes of the handles 560, which are shown as having substantially straight radial support members that are joined to the central mount 562, and substantially horizontal support members that may be gripped by users who are transporting basket 550, e.g., as part of a combination carrying device having a bag such as one of the bags 110, 210, 310 of FIG. 1A, 1B, 2A, 2B or 3 therein, using their respective hands, forearms, elbows or any other body parts. The handles 560 include intersections between the radial support members and the horizontal support members that are ergonomically shaped, e.g., rounded, and not squared or pointed, to avoid potentially injuring a user or one or more individuals, or damaging property, as a combination carrying device including the basket 550 is carried by the user.

As is discussed above, the baskets and bags disclosed herein may be formed of any size and may have any dimensions. For example, in one implementation, a basket may have a height of approximately ten to fifteen inches (10-15"), a length of approximately twelve to twenty-four inches (12-24") and a width of approximately nine to eighteen inches (9-18"), and may define tapered volumes for receiving and nesting a bag therein. Such baskets may further include rotatable handles having a maximum length of approximately six to nine inches (6-9"). The bags may have any heights, lengths, widths or volumes corresponding to the heights, lengths, widths or volumes of the baskets, and may be sized to be accommodated within such baskets.

As is discussed above, the handles of the baskets of the combination carrying devices disclosed herein may have lengths corresponding to the upper perimeter of volumes defined by such baskets, and may be rotatably mounted and aligned near a center of a long side of the baskets along the upper perimeter, such that the handles may be rotated upwardly and inwardly to enable the combination carrying devices to be carried by a user, or downwardly and outwardly to enable the bags to be removed from the baskets or to enable the baskets to be stacked. The rotatable mounting and alignment of the handles further may provide additional clearance for items that are substantially taller than either of the long sides or the short sides of the baskets to be carried within bags nested therein.

Figure 6B:
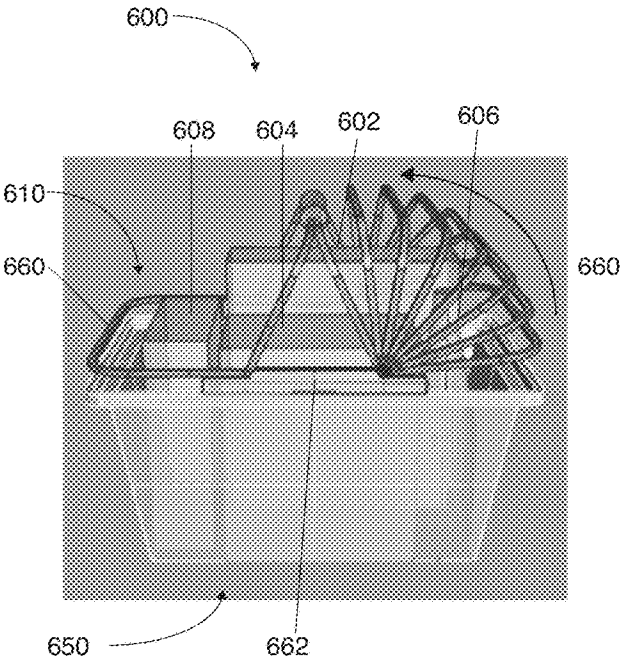
FIGS. 6A and 6B are views of one combination carrying device in accordance with the present disclosure.
Figure 6A:
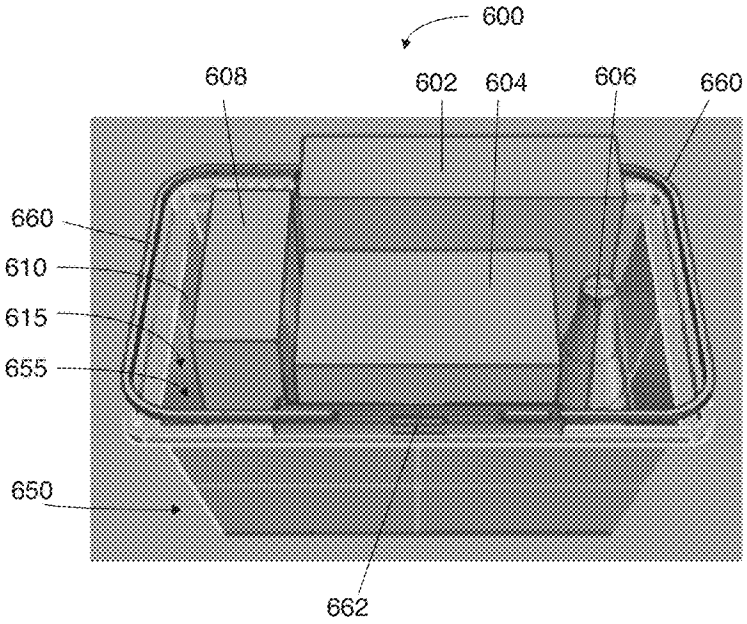

Referring to FIGS. 6A and 6B, views of one combination carrying device 600 in accordance with the present disclosure are shown. Except where otherwise noted, reference numerals preceded by the number "6" shown in FIG. 6A or FIG. 6D indicate components or features that are similar to components or features having reference numerals preceded by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

Referring to FIG. 6A, a top perspective view of the combination carrying device 600 shows a bag 610 and a basket 650. The bag 610 is nested within a volume 655 of the basket 650 and includes a volume 615 having a plurality of items 602, 604, 606, 608 of various sizes disposed therein. As is shown in FIG. 6A, the basket 650 comprises a pair of handles 660 that are mounted to central mounts 662 provided near an upper perimeter of the volume 655, and are rotated downwardly and outwardly, such that the handles 660 rest atop the upper perimeter of the volume 655.

As is discussed above, however, the handles 660 may be rotated upwardly and inwardly, such that the handles 660 meet above the volume 615 of the bag 610, and enable a user to carry the combination carrying device 600 throughout a materials handling facility. Referring to FIG. 6B, a front perspective view of the combination carrying device 600 of FIG. 6A is shown. As is shown in FIG. 6B, the handles 660 are independently and rotatably mounted to an upper perimeter of the volume 655 of the basket 650, such that each of the handles 660 may be rotated between the upper perimeter of the volume 655 and a point above a centroid of the bag 610 and the basket 650, at which a user may collectively grasp the handles 660 in order to transport the combination carrying device 600 throughout a material handling facility or at any other relevant location at which the combination carrying device 600 is provided.

As is further shown in FIG. 6B, the rotatable mounting and alignment of the handles 660 about the upper perimeter of the volume 655 enables the items 602, 604, 606, 608, which are substantially taller than or have dimensions that are greater than any of the sides of the basket 650, to be carried within the combination carrying device 600, as the handles 660 may be rotated above such items 602, 604, 606, 608. The maximum height of an item that may be carried therein may be defined by a sum of a depth of the basket 650 and an interior radial length of the handle 660. For example, where the basket has a depth of approximately twelve inches (12"), and the handle has an interior radial length of approximately eight inches (8"), items having heights of up to approximately twenty inches (20") may be accommodated within the basket in a central region thereof. As is shown in FIG. 6B, the largest of the items 602, 604, 606, 608, viz., item 602, may be positioned substantially centrally within the combination carrying device 600, such that the handles 660 may be rotated from the upper perimeter of the basket 650 upwardly and inwardly to meet above the items 602, 604, 606, 608 with sufficient clearance such that a user may grasp the handles 660 and carry the combination carrying device 600 thereby.

Figure 7B:
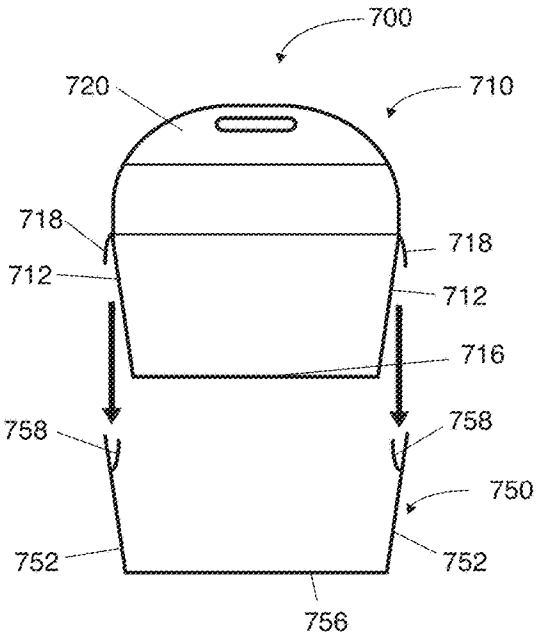
FIGS. 7A and 7B are views of components of one combination carrying device in accordance with implementations of the present disclosure.
Figure 7A:
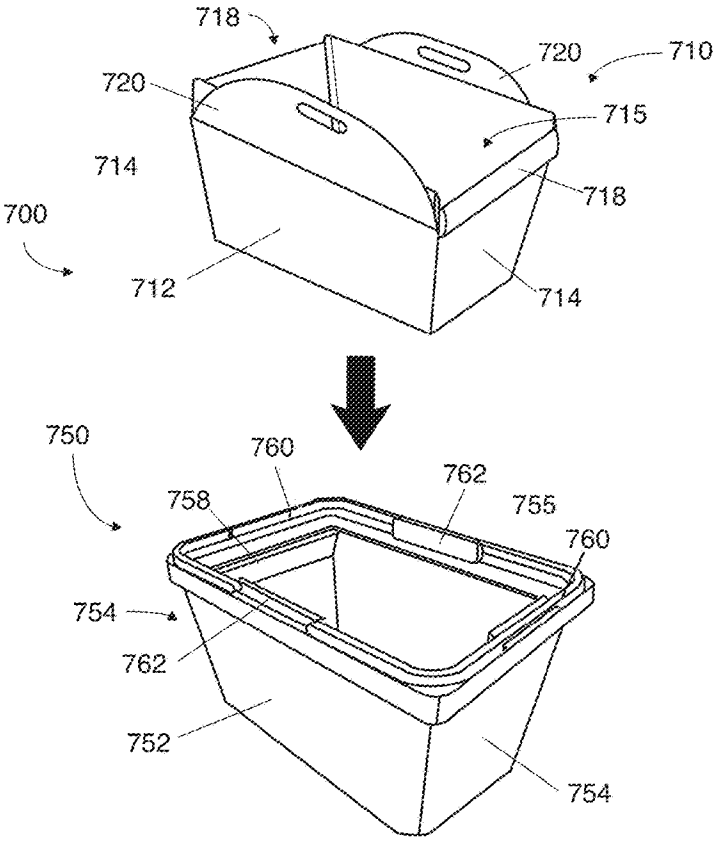

As is also discussed above, the combination carrying devices of the present disclosure may include bags and baskets, as well as one or more features that enable a bag to be nested within a basket, and releasably secured in place until a user elects to extract the bag from the basket. Such baskets may include one or more slits, clips or other features that are provided to mate with a pocket, tab or other feature on a bag in order to releasably maintain the bag within the basket. Referring to FIGS. 7A and 7B, views of one combination carrying device 700 in accordance with the present disclosure are shown. Except where otherwise noted, reference numerals preceded by the number "7" shown in FIG. 7A or FIG. 7B indicate components or features that are similar to components or features having reference numerals preceded by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

As is shown in FIGS. 7A and 7B, the combination carrying device 700 includes a bag 710 and a basket 750. The bag 710 includes a pair of long sides 712, a pair of short sides 714 and a bottom 716 which define a volume 715 for receiving one or more items therein. Additionally, as is also shown in FIGS. 7A and 7B, the bag 710 includes a pocket 718 provided on each of the short sides 714, along an upper portion of an outer edge. The basket 750 is formed from a pair of long sides 752, a pair of short sides 754 and a bottom 756 which define a volume 755 for receiving the bag 710 therein. As is further shown in FIGS. 7A and 7B, the basket 750 further includes a hook 758 or latch provided on each of the short sides 754, along an upper portion of an inner edge.

In accordance with implementations of the present disclosure, the pockets 718 of the bag 710 and the flat hooks 758 of the basket 750 are provided to mate with one another when the bag 710 is nested within the basket 750, thereby releasably maintaining the bag 710 within the basket 750. The hook 758 and the short side 754 may define a narrow gap into which the pocket 718 may be inserted. According to some implementations of the present disclosure, the hook 758 may be releasably biased into the short side 754, such that a human operator or machine may separate the hook 758 from the short side 754 and open a nominal (e.g., three-sixteenths of an inch) gap therebetween in order to insert at least a portion of the pocket 718 therein. The degree or extent of the bias provided by the hook 758 may be sufficiently high enough to maintain the bag 710 within the basket 750 during normal use of the combination carrying device 700, yet sufficiently low enough to allow the bag 710 to be extracted from the basket 750 by simply raising the bag 710 therefrom by the handles 720.

Maintaining the bag 710 within the basket 750 of the combination carrying device 700 using the hook 758 and the pocket 718 enables the combination carrying device 700 to be stacked in a nested configuration along with other combination carrying devices 700, with bags 710 interleaved with each of the baskets 750. In this regard, a user may retrieve one of the combination carrying devices 700 from the stack upon arriving at a materials handling facility with confidence that the bag 710 will remain within the basket 750 of the combination carrying device 700 that he or she has retrieved. Maintaining the bag 710 within the basket 750 of the combination carrying device 700 also enables a user to transition the items from the basket 710 as a single unit by removing the bag 710 and the contents thereof from the basket 750 by lifting the handles 720. Such a quick transition is beneficial when moving picked items to a packing station, when checking out at a retail establishment and/or at other transition points where a separate step of removing items from a basket and/or bagging of removed items is traditionally required.

Although the combination carrying device 700 of FIGS. 7A and 7B includes the hook 758 and the pocket 718 for releasably maintaining the bag 710 within the basket 750, those of ordinary skill in the pertinent arts will recognize that any type or form of devices or implements may be provided on bags or baskets of the present disclosure for this purpose. For example, a hook and loop fastener including male and female parts may be provided, with one of the male or female parts provided on an underside of the bottom 716 of the bag 710, and the other of the male or female parts provided on an inner surface of the bottom 756 of the basket 750, in an alignment that ensures that the bag 710 remains in releasable contact within the basket 750. The devices or implements for maintaining bags and baskets releasably in contact with one another in combination carrying devices of the present disclosure are not limited.

Figure 8B:
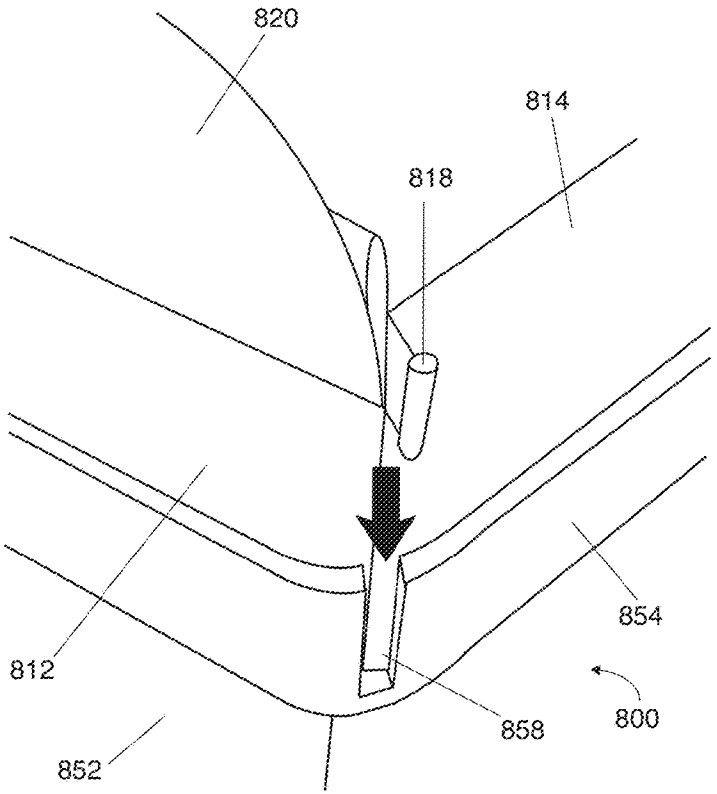
FIGS. 8A and 8B are views of components of one combination carrying device in accordance with implementations of the present disclosure.
Figure 8A:
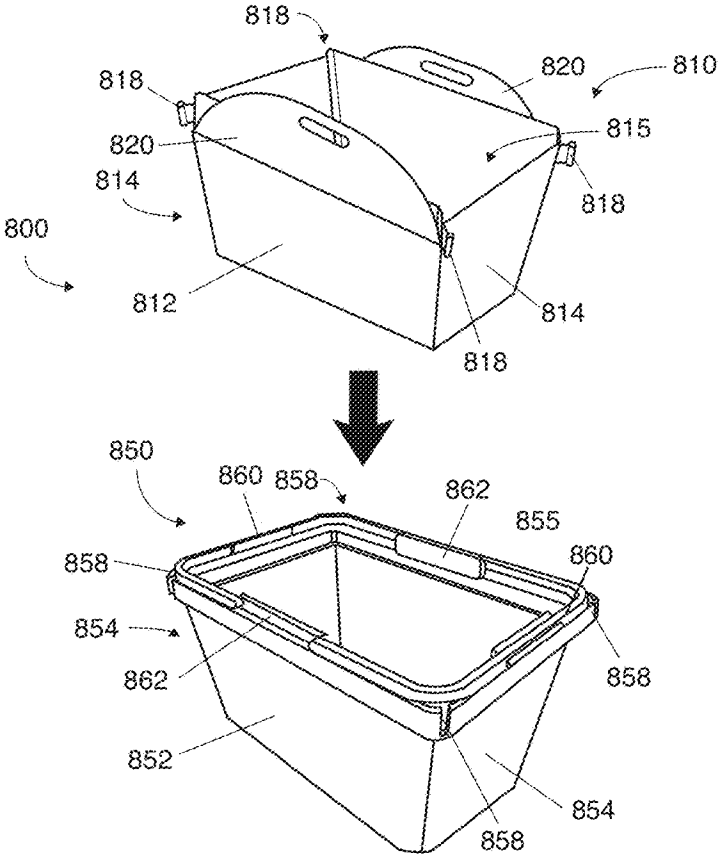

Referring to FIGS. 8A and 8B, views of one combination carrying device 800 in accordance with the present disclosure are shown. Except where otherwise noted, reference numerals preceded by the number "8" shown in FIG. 8A or FIG. 8B indicate components or features that are similar to components or features having reference numerals preceded by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

As is shown in FIGS. 8A and 8B, the combination carrying device 800 includes a bag 810 and a basket 850, with the bag 810 including a pair of long sides 812, a pair of short sides 814 and a bottom 816 which define a volume 815 for receiving one or more items therein. Additionally, as is also shown in FIGS. 8A and 8B, the bag 810 includes a plurality of tabs 818 or other extensions provided at each of the corners where one of the long sides 812 meets one of the short sides 814, near an upper perimeter of the volume 815. The tabs 818 may be formed from any material and may be joined at a proximal end to the bag 810 at one of the long sides 812 or one of the short sides 814 thereof, e.g., by stitching, staples or adhesives.

The tabs 818 may include portions of varying thicknesses. For example, in some implementations, the tabs 818 may be formed from straps or other like materials that are folded or creased at a distal end thereof, with the ends of each of the straps joined to either or both of a long side 812 and a short side 814, and the fold or crease of the straps defining a wider terminus at a distal end of the tabs 818. Alternatively, the tabs 818 may include one or more additional folds, creases or knots at distal ends thereof.

As is also shown in FIGS. 8A and 8B, the basket 850 is formed from a pair of long sides 852, a pair of short sides 854 and a bottom 856 which define a volume 855 for receiving the bag 810 therein. The basket 850 further includes slots 858 or other narrow openings provided at each of the corners where one of the long sides 852 meets one of the short sides 854, near an upper perimeter of the volume 855. The slots 858 may be formed within the basket 850 in any manner, e.g., when the basket is formed, or by any punching, drilling, slicing or like manual or automatic processes.

In accordance with some implementations of the present disclosure, the tabs 818 of the bag 810 and the slots 858 of the basket 850 are provided to mate with one another when the bag 810 is nested within the basket 850, thereby releasably maintaining the bag 810 within the basket 850. The dimensions of the slot 858 of the baskets 850 may be selected based on one or more dimensions of the tabs 818 of the bags 810. For example, the slot 858 of a basket 850 may be formed to snugly accommodate the tab 818 of a bag 810, such that friction or biasing forces maintain the tab 818 within the slot 858, and the bag 810 within the basket 850 accordingly. According to some implementations of the present disclosure, the slot 858 and the bag 818 may each have a nominal (e.g., three-sixteenths of an inch) gap thickness. The degree or extent of the friction or bias provided by the slot 858 may be sufficiently high enough to maintain the bag 810 within the basket 850 during normal use of the combination carrying device 800, yet sufficiently low enough to allow the bag 810 to be extracted from the basket 850 by simply raising the bag 810 therefrom by the handles 820.

As with the combination carrying device 700 of FIG. 7, maintaining the bag 810 within the basket 850 of the combination carrying device 800 using the slot 858 and the tab 818 enables the combination carrying device 800 to be stacked in a nested configuration along with other combination carrying devices 800, with bags 810 interleaved with each of the baskets 850. A user may retrieve one of the combination carrying devices 800 from the stack upon arriving at a materials handling facility with confidence that the bag 810 will remain within the basket 850 of the combination carrying device 800 that he or she has retrieved. Maintaining the bag 810 within the basket 850 of the combination carrying device 800 also enables a user to transition the items from the basket 810 as a single unit by removing the bag 810 and the contents thereof from the basket 850 by lifting the handles 820.

As is discussed above, the combination carrying devices of the present disclosure may include baskets having pivotable or rotatable handles mounted about upper perimeters thereof. The handles may be specifically shaped and mounted to a basket such that the handles may closely and tightly conform to the upper perimeter of the basket when folded down, e.g., into a first position, and may join together when folded to a point substantially over a centroid of the basket, e.g., at a second position, when the basket is in use.

Referring to FIGS. 9A through 9D, views of one basket 950 for use in embodiments of combination carrying devices in accordance with the present disclosure are shown. Except where otherwise noted, reference numerals preceded by the number "9" shown in FIG. 9A, 9B, 9C or 9D indicate components or features that are similar to components or features having reference numerals preceded by the number "8" shown in FIG. 8A or FIG. 8B, by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

Figure 9A:
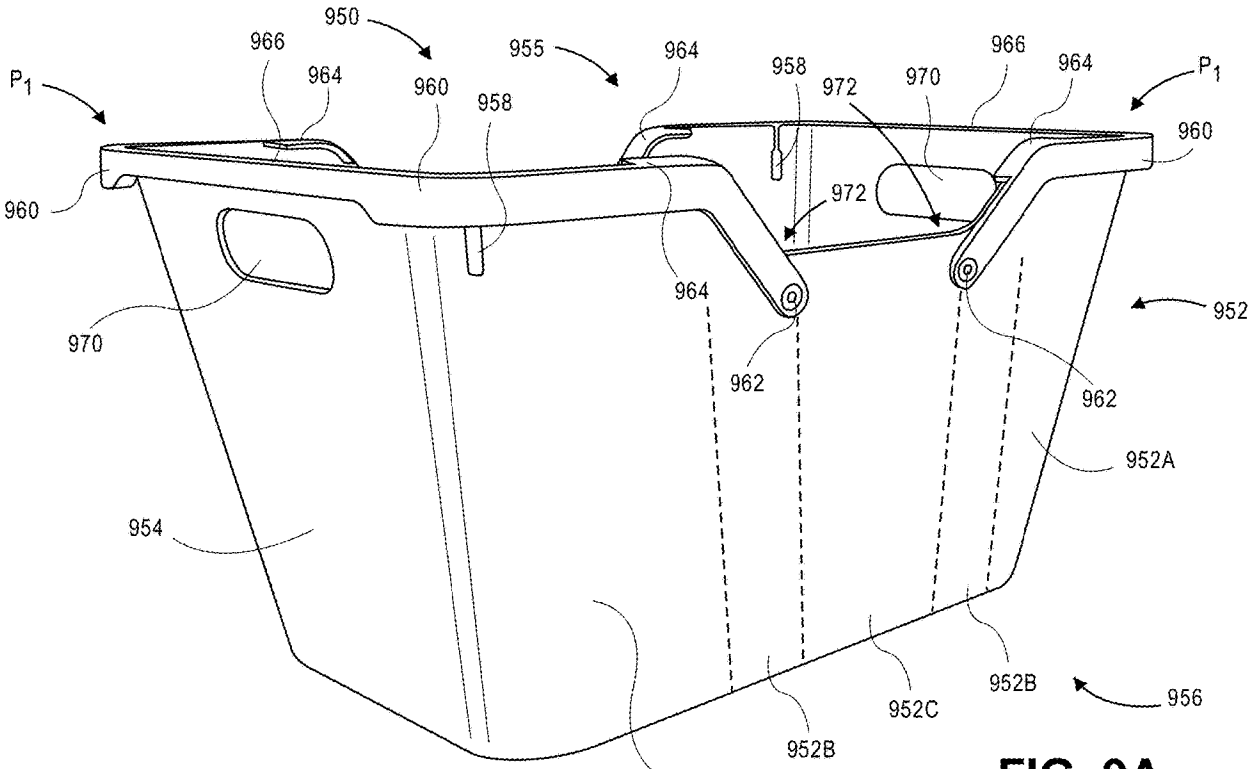
FIGS. 9A through 9D are views of components of one combination carrying device in accordance with implementations of the present disclosure.
Figure 9B:
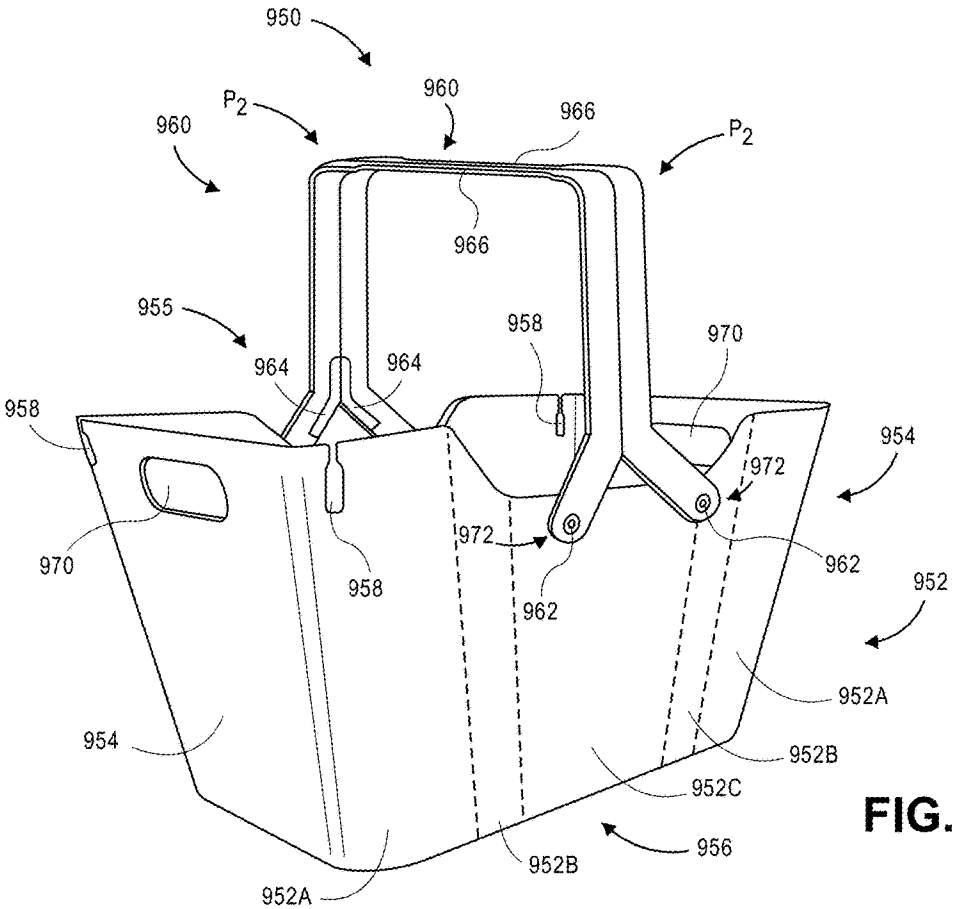

As is shown in FIGS. 9A and 9B, the basket 950 includes a pair of long sides (or side panels) 952, a pair of short sides (or end panels) 954 and a bottom (or bottom panel) 956 formed in a tapered, frustopyramidal shape defining a volume 955. As is shown in FIGS. 9A and 9B, the volume 955 has a substantially rectangular horizontal cross-section with areas of descending size, from top to bottom, beginning with an area defined by upper edges of the long sides 952 and the short sides 954, and concluding with an area of the bottom 956.

The basket 950 further includes a plurality of slots 958 provided along the upper perimeter of the basket 950, in corners at intersections of corresponding long sides 952 and short sides 954. As is also shown in FIGS. 9A and 9B, the long sides 952 of the basket 950 each have end portions 952A having heights that are substantially equal to the heights of the short sides 954, and central portions 952C having heights that are substantially shorter than the heights of the short sides 954, with angled, slanted, curved or tapered portions 952B connecting the end portions 952A and the central portions 952C. Thus, an upper perimeter of the basket 950 includes a pair of end sections or levels at a first height (e.g., a height of the short sides 954 and the end portions 952A of the long sides 952), a pair of central sections or levels at a second height (e.g., a height of the central portions 952C of the long sides 952), and angled sections or levels extending between the end sections or levels and the central sections or levels (e.g., a height of the angled portions 952B of the long sides 952). Additionally, the slots 958 may receive a tab or other extension of a bag (not shown) nested within the basket 950, and may further aid in ensuring that the bag remains nested therein.

Although the basket 950 of FIGS. 9A and 9B is formed from two long sides 952, two short sides 954 and a bottom 956, with each of the long sides 952, each of the short sides 954 and the bottom 956 being substantially polygonal in shape and substantially planar in form, those of ordinary skill in the pertinent arts will recognize that the baskets 950 of the present disclosure need not be formed from four substantially planar polygonal sides and/or with a single substantially planar polygonal bottom. For example, referring again to FIG. 9A, the long sides 952 and the short sides 954 need not intersect at a straight line, and may, in some implementations, include one or more intervening surfaces (e.g., a corner panel in the form of a flat or rounded section extending between and joining a long side 952 and a short side 954) between them.

Moreover, those of ordinary skill in the pertinent arts will further recognize that the intersections between the various sides or the bottom (e.g., the intersection between a long side 952 and a short side 954, or between either a long side 952 or a short side 954 with one or more intervening surfaces) need not be defined by single line segments. For example, in some implementations, the intersections between such sides and/or surfaces or the bottom may comprise one or more straight or curvilinear segments joining the various sides, surfaces or bottom of the baskets to one another.

Furthermore, where a basket is formed with various intervening surfaces between long sides or short sides, with sides or bottoms of shapes other than polygons or in non-planar (e.g., curved) forms, or with intersections of one or more straight or curvilinear segments, a bag that is intended to be nested within the basket may be similarly formed with sides, surfaces or a bottom of a similar shape or form, and with intersections of similar straight or curvilinear segments, such that the bag defines a volume corresponding to a volume of the basket.

The basket 950 further includes a pair of pivotable handles 960 and a pair of slotted handles 970. Each of the handles 960 has a shape that substantially conforms to portions of the upper perimeter of the basket 950, and is mounted or otherwise attached on opposite sides of the basket 950 by fasteners 962, e.g., about or near the central portions 952C of the long sides 952, and includes a pair of extensions 964 and a grip 966.

The basket 950 further includes a pair of angled mounting bores 972 provided on opposite long sides 952 for each of the handles 960, which may be mounted or attached at opposite ends thereof to one or more locations on the basket 950 by way of the bores 972. The bores 972 may be associated with the long sides 952 in any manner. For example, in some implementations, the bores 972 may be formed integral to the long sides 952 of the basket 950 by injection molding, or by any means by which the baskets 950 are formed. Alternatively, the bores 972 may be independent implements that are mechanically joined to the long sides 952 after the baskets 950 have been formed.

Each of the handles 960 is mounted or attached to the long sides 952 via the bores 972 in a manner that allows the handles to pivot or rotate between a first position $P_1$, such as is shown in FIG. 9A, e.g., where each of the handles 960 is folded down and in contact with the upper perimeter of the basket 950, and a second position $P_2$, such as is shown in FIG. 9B, e.g., where the handles 960 are folded up and in contact with one another, substantially above a centroid of the basket 950 and/or the volume 955. In accordance with implementations of the present disclosure, the handles 960 may be formed from any suitable materials, such as plastics (e.g., thermoplastics or thermosetting plastics such as epoxy or phenolic resins, polyurethanes or polyesters, as well as polyethylenes, polypropylenes or polyvinyl chlorides, acrylonitrile butadiene styrenes, as well as recycled plastics, bioplastics, cellulose or compostable plastics, natural plastics), wood (e.g., woods with sufficient strength properties such as ash), metals (e.g., lightweight metals such as aluminum), composites or other durable materials that may be gripped by a user and support the weight of the baskets 950 and any contents provided therein. Additionally, in accordance with other implementations of the present disclosure, the handles 960 may have any suitable length with respect to one or more dimensions of the baskets 950, in order to accommodate objects of varying sizes or shapes within the volume 955.

As is shown in FIG. 9A, the extensions 964 are angled mechanical stops that are provided on portions of the handles 960 which correspond to upper edges of the long sides 952. The extensions 964 are provided on the handles 960 in order to prevent or restrict the handles 960 from pivoting or rotating beyond the first position $P_1$, and are configured to extend over and come into contact with portions of the upper edges of the end sections and the angled sections of the respective long sides 952 when each of the handles 960 is in the first position $P_1$. Where the extensions 964 include portions that are configured to come into contact with and correspond to the upper edges of the long sides 952 at different planes, e.g., the end portions 952A and the angled portions 952B, the handles 960 may rest more securely atop the basket 950 when the handles 960 are folded into the first position $P_1$.

As is also shown in FIG. 9A, the grips 966 are narrowed portions of the handles 960. The grips 966 rest on or lie near the short sides 954 of the basket 950 when the handles 960 are pivoted or rotated into the first position $P_1$, and functionally join together with one another when the handles 960 are pivoted or rotated into the second position $P_2$. As is shown in FIG. 9B, the grips 966 of each of the handles 960 may have substantially smaller cross-sectional areas than the remainder of the handles 960, e.g., the end portions of the handles 960 that are joined to the baskets 950 at the bores 972. For example, when the handles 960 are pivoted or rotated into the first position $P_1$, a vertical height of the grip 966 is shorter than a vertical height of the remainder of the handles 960. When the handles 960 are pivoted or rotated into the second position $P_2$, a horizontal width of either of the grips 966 is shorter than a horizontal width of the remainder of the handles 960.

The handles 960 may also include one or more flat surfaces that come into contact with one another when each of the handles is pivoted or rotated into the second position $P_2$. In this regard, when each of the handles 960 is pivoted or rotated into the second position $P_2$, such as is shown in FIG. 9B, the grips 966 of the handles 960 may effectively define a single, grippable cross-section that may be grasped by one or more hands of a user, or carried about one or more arms of the user. Additionally, each of the handles 960 may have a rounded external edge thereof, such that when the handles 960 are pivoted or rotated into the second position $P_2$, the grips 966 form a combined cross-section that is comfortable to a user of the basket 950 who is grasping the grips 966 with one or more hands or carrying the basket 950 by way of the handles 960 with one or more arms. Similarly, the slotted handles 970 are shown as being provided on the short sides 954, and may be fixed openings within the short sides 954 that may accommodate hands or other body parts of a worker in order to manipulate the basket 950 and any bag or contents (not shown) provided therein.

The bores 972 are substantially cylindrical openings provided on the long sides 954 and extending between an interior of the basket 950 and an exterior of the basket 950. The bores 972 may include one or more flanges or collars that are sized and shaped to correspond with and accommodate the fastener 962 extending therethrough. Whereas the long sides 952 of the basket 950 are provided at obtuse angles with respect to the bottom 956, thereby defining the tapered, frustopyramidal volume of the basket 950 at least in part, the bores 972 are provided with flat faces that are substantially vertical, e.g., perpendicular to the bottom, and with openings that are substantially horizontal, e.g., parallel to the bottom 956. Thus, when the handles 960 are mounted or attached to the basket 950 by way of fasteners 962 (e.g., one or more connectors such as threaded bolts or screws, rivets or like components) inserted into the bores 972, the substantially vertical flat faces of the bores 972 enable the ends of the handles 960 that are pivotably or rotatably mounted or attached to the long sides 952 to pivot or rotate between the first position $P_1$ and the second position $P_2$ in planes that are parallel to the flat faces of the bores 972, and perpendicular to the bottom 956.

Those of ordinary skill in the pertinent arts will recognize that the handles 960 shown in FIGS. 9A and 9B may be mounted or attached by way of the bores 972 at any location with respect to the upper perimeter of the basket 950, and may include any number of extensions 964 which may prevent the handles 960 from rotating beyond the first position $P_1$. Such extensions 964 may be provided on portions of the handles 960 corresponding to the long sides 952, the short sides 954, or both the long sides 952 and the short sides 954, and on sections of such sides that are aligned at any angle or within any plane.

Figure 9C:
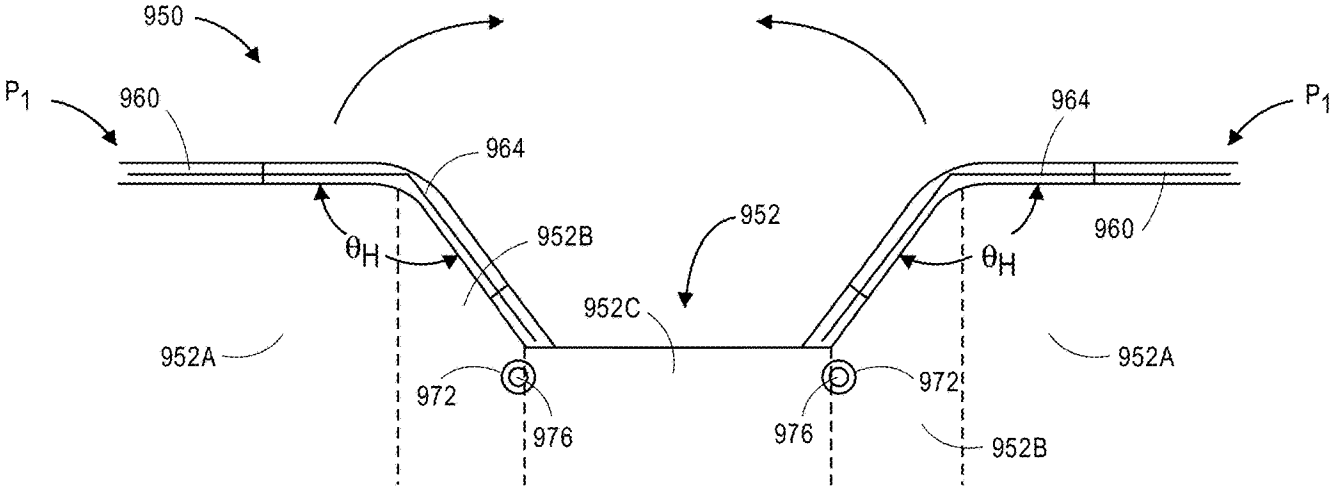
Figure 9D:
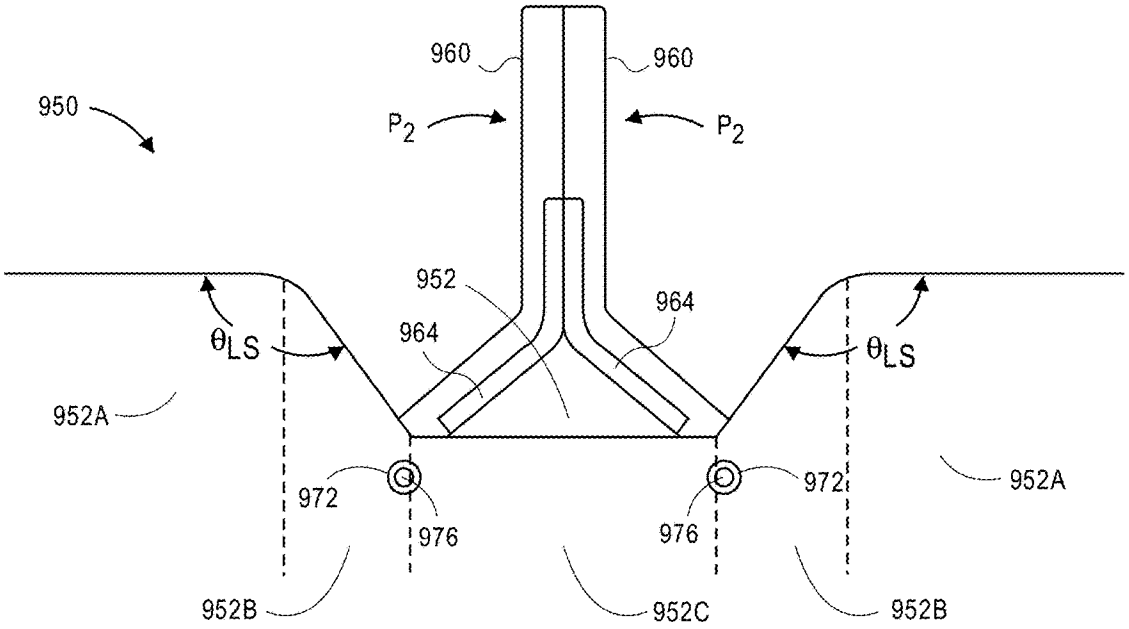

Depending on their respective dimensions and positions on the handles 960, the extensions 964 may restrict the extent to which the handles 960 may pivot or rotate in multiple directions. Referring to FIGS. 9C and 9D, two handles 960 are shown as being pivotably or rotatably mounted or attached to one of the long sides 952 to the bores 972 via a pair of fasteners 976. The mounting of the handles 960 permits the handles to be rotated or pivoted from a first position $P_1$, as is shown in FIG. 9C, with the extensions 964 resting on the upper edge of the long side 952, to the second position $P_2$, as is shown in FIG. 9D, with ends of the extensions 964 resisting the rotation of each of the handles 960 beyond the second position $P_2$. In this regard, the extensions 964 act to limit the rotation of each of the respective handles 960.

As is shown in FIGS. 9C and 9D, the handles 960 are specifically shaped and mounted to the basket 950 such that the handles 960 may closely and tightly conform to the portions of the upper perimeter of the basket 950 associated with the end portions 952A and the angled portions 952B when the handles 960 are folded down, e.g., into the first position $P_1$, and may join together when folded to a point substantially over a centroid of the basket, e.g., at a second position $P_2$, when the basket is to be carried by a user. As is shown in FIGS. 9C and 9D, the handles 960 may thus define an angle $\theta_H$ that substantially conforms to an angle $\theta_{LS}$ defined by the long side 952, e.g., by the shapes and dimensions of the end portions 952A and the angled portions 952B. For example, in some implementations, the angle $\theta_{LS}$ defined by the end portions 952A and the angled portions 952B of the long side 952, and the angle $\theta_H$ defined by the handles 960, are each approximately one hundred twenty degrees (120°).

In some implementations, the baskets of the present disclosure may include rotatable or pivotable handles that are mounted or otherwise attached to external sides of the baskets, and have one or more dimensions (e.g., lengths) which cause the handles to extend beyond the upper perimeters of the baskets. The extended lengths of such handles permit bags to be nested within the baskets when the handles are folded down onto the upper perimeters of the baskets, and further expand the carrying capacity of such baskets when the handles are folded upward.

Figure 10A:
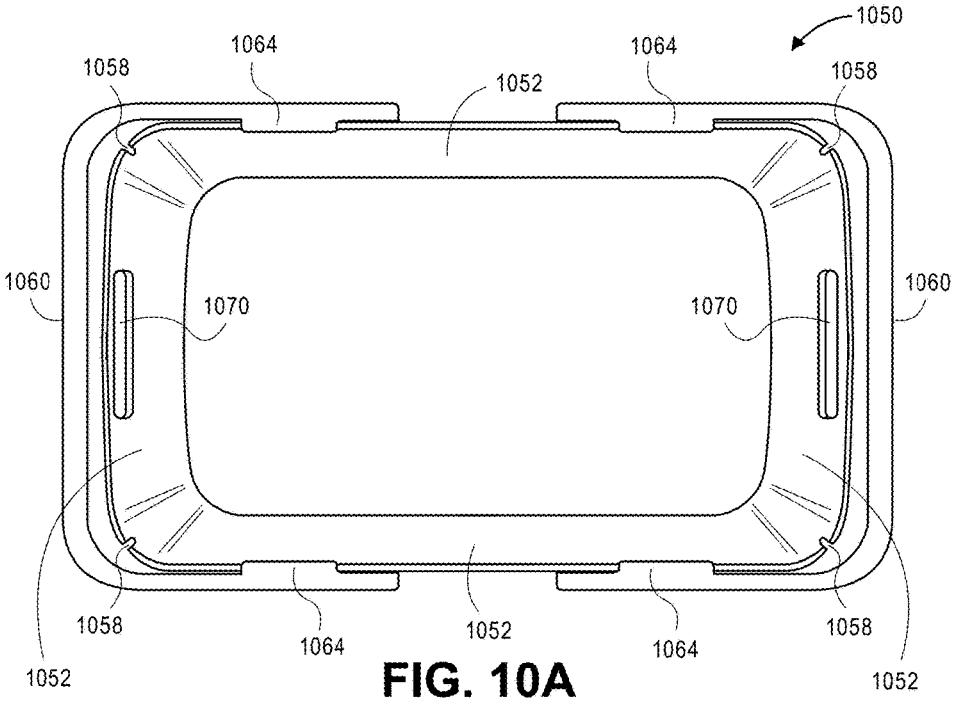
FIGS. 10A and 10B are views of components of one combination carrying device in accordance with implementations of the present disclosure.
Figure 10B:
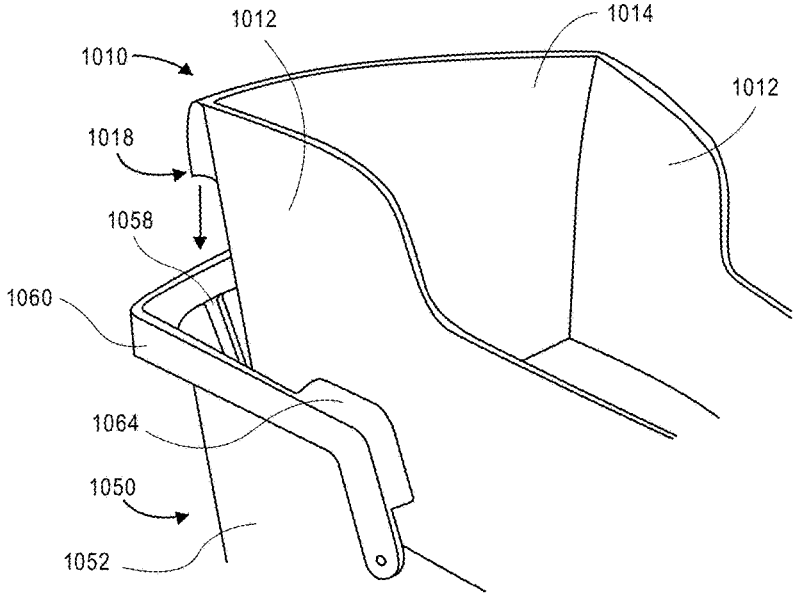

Referring to FIGS. 10A and 10B, views of one basket 1050 for use in embodiments of combination carrying devices in accordance with the present disclosure are shown. Except where otherwise noted, reference numerals preceded by the number "10" shown in FIG. 10A or 10B indicate components or features that are similar to components or features having reference numerals preceded by the number "9" shown in FIG. 9A, 9B, 9C or 9D, by the number "8" shown in FIG. 8A or FIG. 8B, by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

Referring to FIG. 10A, the basket 1050 includes a pair of long sides 1052 and a pair of short sides 1054, along with slots 1058 provided along the upper perimeter of the basket 1050, in the corners between the long sides 1052 and the short sides 1054. The basket 1050 further includes a pair of rotatable or pivotable handles 1060 mounted or otherwise attached to outer surfaces of the long sides 1052 of the basket 1050, along with a pair of slotted handles 1070 cut into the short sides 1054 of the basket 1050. Each of the handles 1060 includes a pair of extensions 1064 for resting atop the upper perimeter of the basket 1050, and preventing further rotation of the handles 1060.

As is also shown in FIG. 10A, each of the pair of handles 1060 has a length that extends beyond the short sides 1054 of the basket 1050. The extended lengths of the handles 1060 enable a bag to be nested within the basket 1050, when the handles 1060 are folded down onto the upper perimeter of the basket, such as is shown in FIG. 10B. Referring to FIG. 10B, a bag 1010 is shown as being nested within the basket 1050. The bag 1010 includes long sides 1012 and short sides 1014, and a pocket 1018 provided on one of the short sides 1014. The pocket 1018 is shown as being stretched over one of the short sides 1054 of the basket 1050, between the slots 1058 provided at two of the corners of the basket 1050.

The spatial relationship and operation of the bores and extensions of some implementations of the baskets disclosed herein are shown in FIGS. 11A through 11D. Referring to FIGS. 11A through 11D, views of one basket 1150 for use in embodiments of combination carrying devices in accordance with the present disclosure are shown. Except where otherwise noted, reference numerals preceded by the number "11" shown in FIG. 11A, FIG. 11B, FIG. 11C or FIG. 11D indicate components or features that are similar to components or features having reference numerals preceded by the number "10" shown in FIG. 10A or FIG. 10B, by the number "9" shown in FIG. 9A, FIG. 9B, FIG. 9C or FIG. 9D, by the number "8" shown in FIG. 8A or FIG. 8B, by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

Figure 11A:
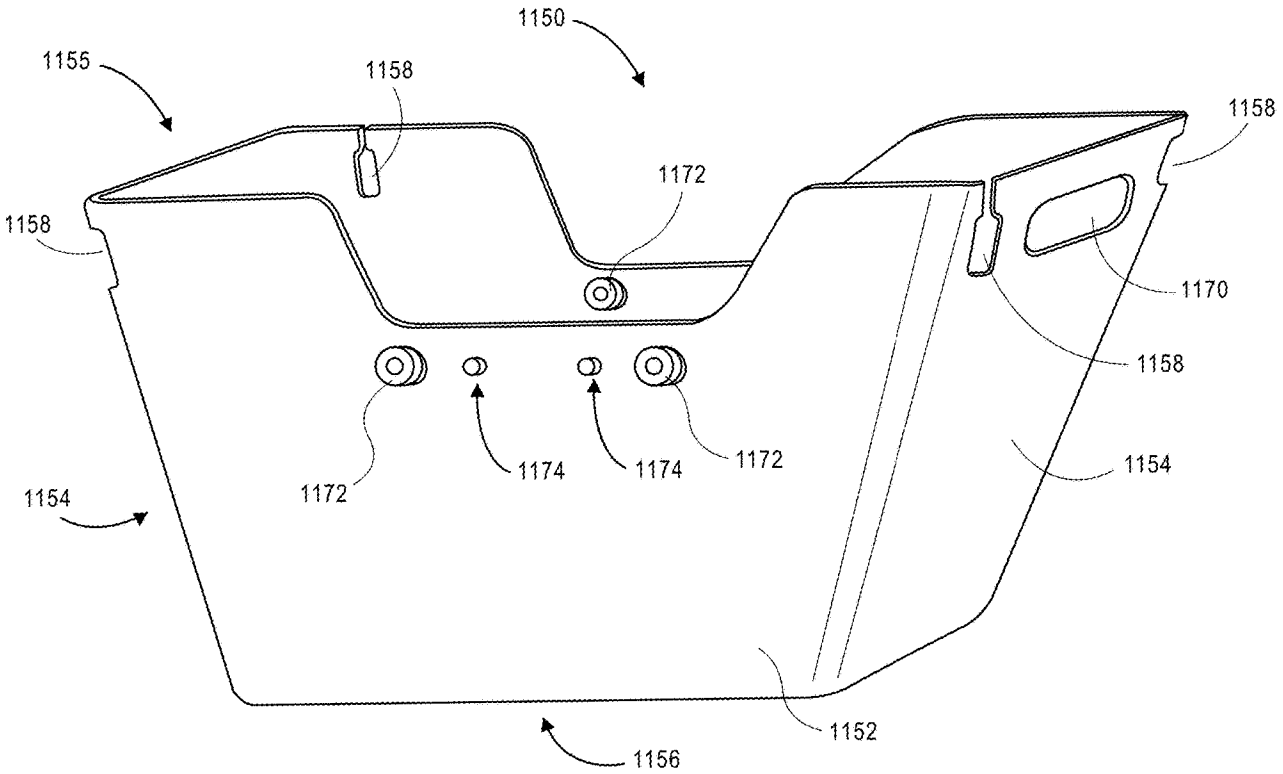
FIGS. 11A through 11D are views of components of one combination carrying device in accordance with implementations of the present disclosure.

As is shown in FIG. 11A, the basket 1150 includes a pair of long sides 1152, a pair of short sides 1154 and a bottom 1156, and defines a tapered, frustopyramidal volume 1155. The basket 1150 further includes slots 1158 provided at each corner of the basket 1150 along an upper perimeter thereof for accommodating one or more tabs or extensions of a bag (not shown) to be nested therein. Additionally, each of the short sides 1154 of the basket 1150 includes slotted handles 1170 provided thereon, near an upper perimeter of the basket 1150, while each of the long sides 1152 of the basket 1150 includes a pair of mounting bores 1172 and a pair of extensions 1174. As is discussed above, the bores 1172 are provided for mounting handles (not shown) to the basket 1150. The extensions 1174 are mechanical stops that are provided on the external faces of the long sides 1152, in order to prevent or restrict the pivoting or rotation of the handles 1160 by coming into contact with a portion of one of the handles 1160 when one of the handles 1160 has pivoted or rotated a predetermined angular extent beyond a second position above a centroid of the basket 1050. In some implementations, the predetermined angular extent is approximately five degrees (5°) beyond the second position, or a total pivoting or rotating angular extent of approximately ninety-five degrees (95°) beyond a first position associated with the upper perimeter of the basket 1150.

Figure 11B:
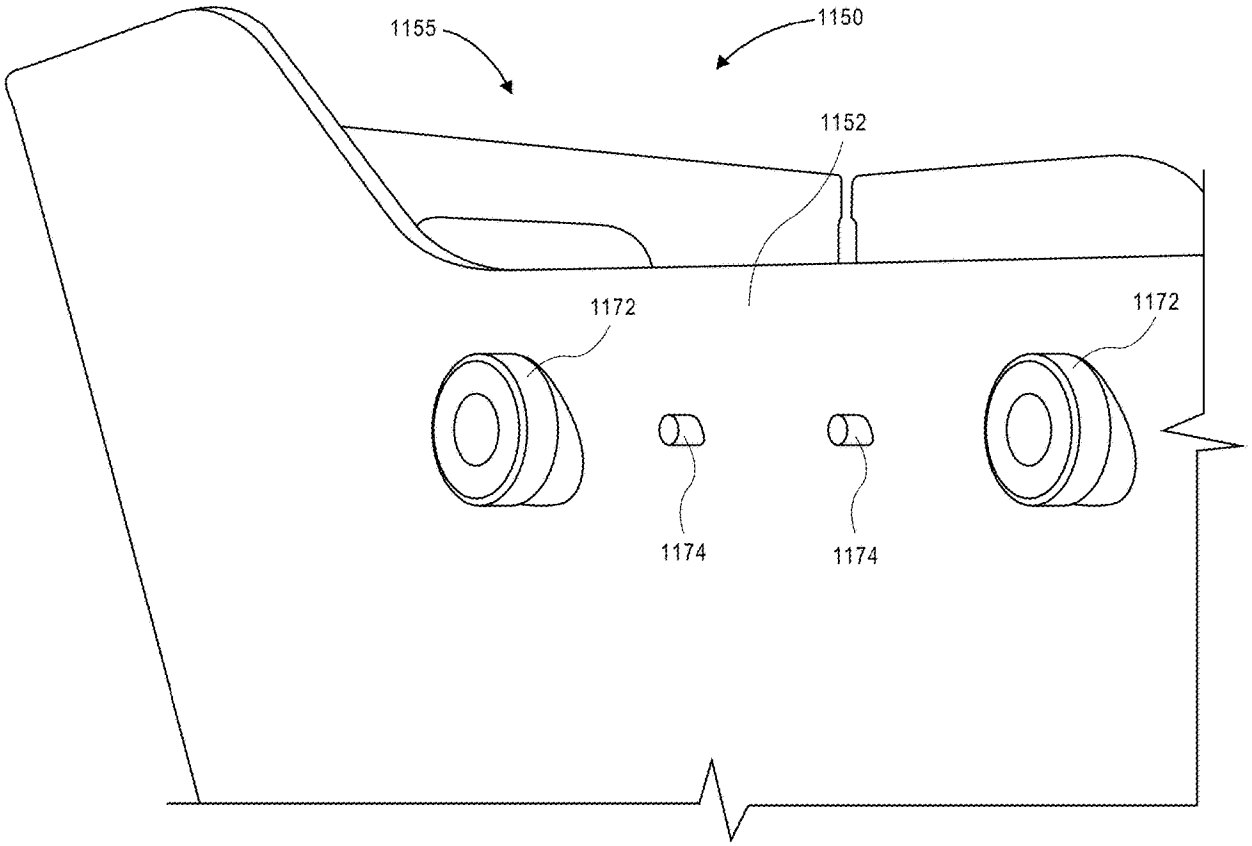

As is shown in FIG. 11B, the bores 1172 and the extensions 1174 provided on the long sides 1152 of the basket 1150 are aligned substantially horizontally. The bores 1172 may accommodate any type or form of fastener (not shown) for pivotably or rotatably securing an end of a handle 1160 to the long side 1152. As is also shown in FIG. 11B, the bores 1172 also include substantially vertical external faces against which a handle (not shown) may be mounted to the basket 1150. As opposed to the tapered, obtuse angle of the long side 1152 of the basket 1150, the vertical faces of the bores 1172 enable the handles 1160 to rotate within a vertical plane about an axis defined by the bores 1172. Additionally, the extension 1174 is mounted to the long side 1152, and extends beyond an external face of the long side 1152 to a sufficient extent that permits the extension 1174 to inhibit the rotation of a handle mounted to the long side 1152 at the extension 1174 beyond a nominal angular extent.

Figure 11D:
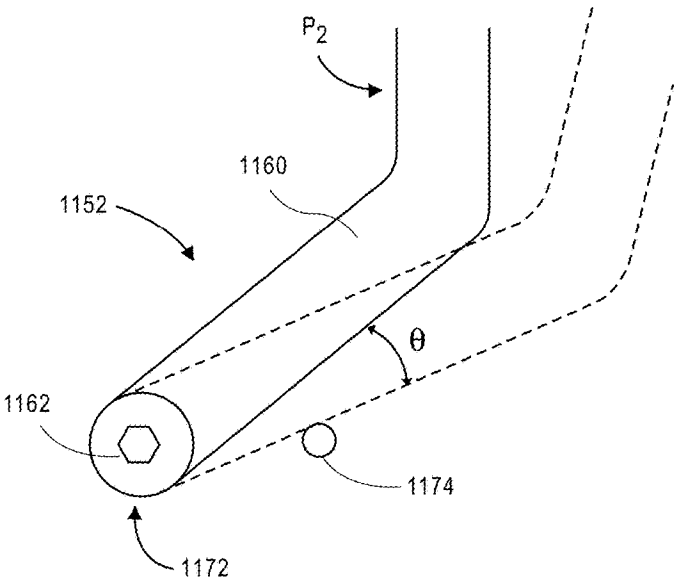
Figure 11C:
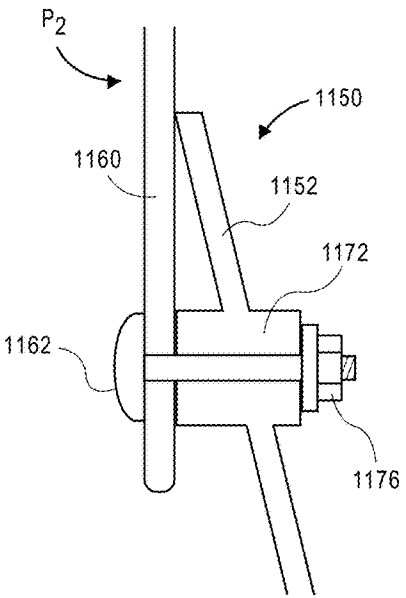

A cross-sectional view of the mounting of a handle 1160 to a basket 1150 by way of a mounting bore 1172 is shown in FIG. 11C. As is shown in FIG. 11C, the bore 1172 is substantially horizontal, and a handle 1160 is joined to a long side 1152 of the basket 1150 at a substantially vertical face of the bore 1172 by a fastener 1162 (e.g., a threaded bolt) and a fastener 1176 (e.g., a threaded nut). As opposed to the angle of the long side 1152, the substantially vertical face of the bore 1172 enables the handle 1160 to rotate in a vertical plane between an upper perimeter of the basket 1150 and above a centroid of the basket 1150, e.g., between the first position $P_1$ and the second position $P_2$ shown in FIGS. 9A and 9B.

Additionally, the use of an extension to inhibit pivoting or rotation of a handle beyond a second position above a centroid of a basket is shown in FIG. 11D. Referring to FIG. 11D, a handle 1160 is shown as mounted to a long side 1152 of a basket (not shown) by a fastener 1162 through a bore 1172. The long side 1152 of the basket further includes an extension 1174. As is discussed above, when each of the handles of a basket is rotated from a first position about an upper perimeter of the basket to a second position above the basket, the handles intersect above a centroid of the basket, where the handles may be collectively grasped by a single hand of a user, or may be collectively provided on a forearm or other bodily extension of the user, and may enable the user to easily carry the basket with one or more items therein. However, when one of the handles is rotated from the first position, and the other handle remains in the first position, e.g., resting on an upper perimeter of the basket, the rotated handle may travel beyond the second position without coming into contact with the other handle. Thus, the extension 1174 is provided in order to prevent the handle 1160 from rotating beyond a second position $P_2$ by a predefined angle θ.

Figure 12A:
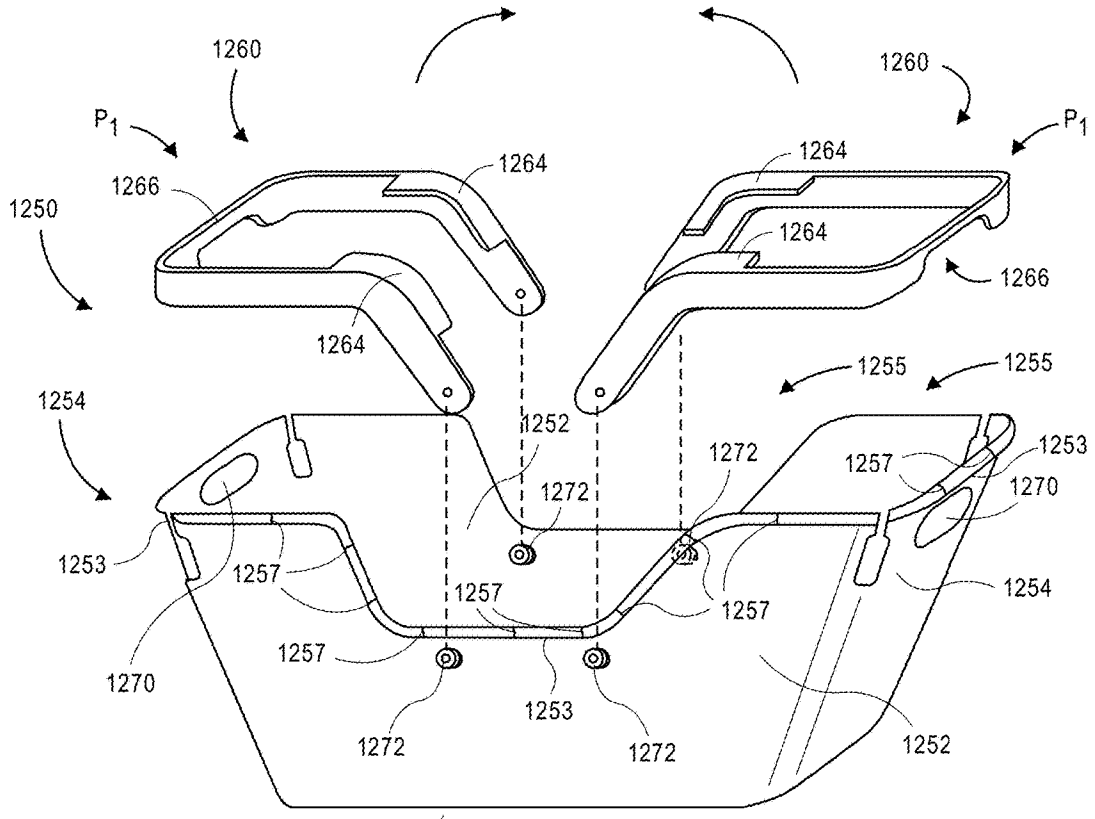
FIGS. 12A and 12B are views of components of one combination carrying device in accordance with implementations of the present disclosure.
Figure 12B:
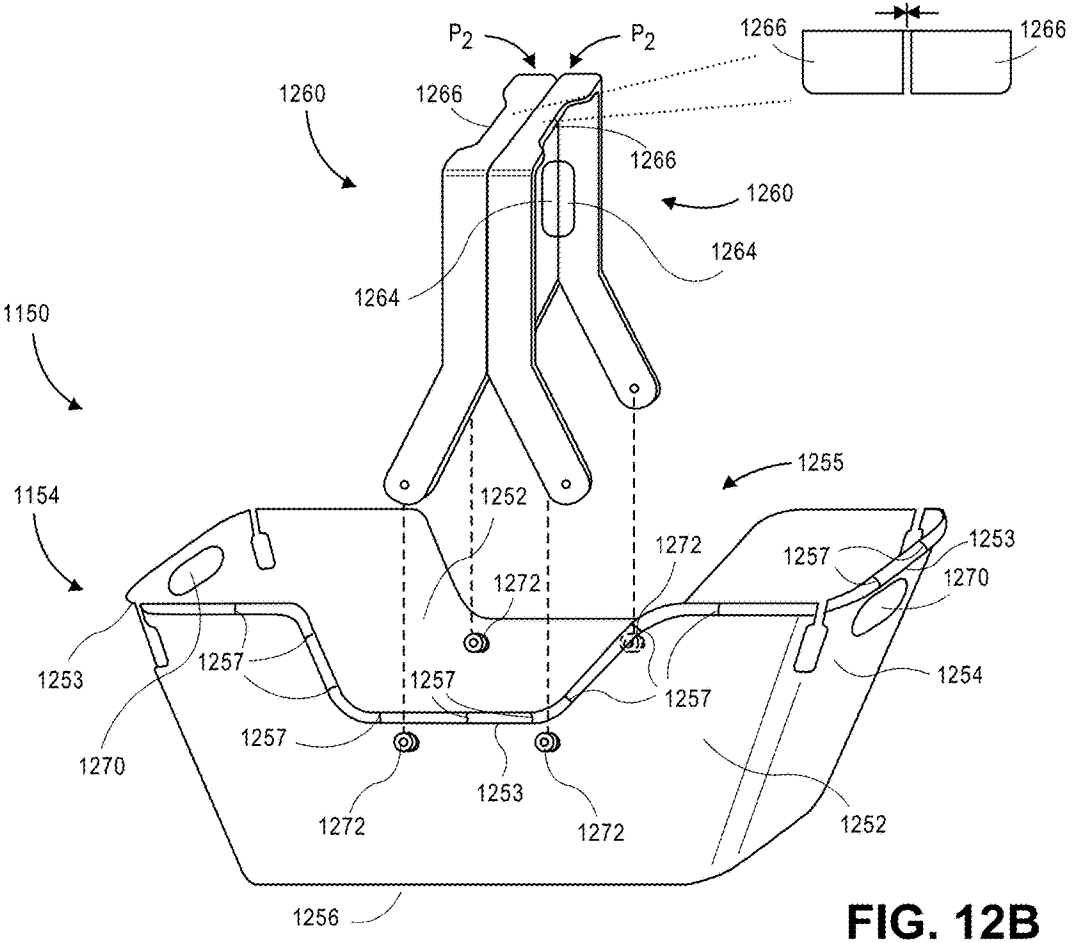

Spatial relationships of baskets and handles in various positions in accordance with some implementations of the present disclosure are shown in FIGS. 12A and 12B. Referring to FIGS. 12A and 12B, views of one basket 1250 for use in embodiments of combination carrying devices in accordance with the present disclosure are shown. Except where otherwise noted, reference numerals preceded by the number "12" shown in FIG. 12A or FIG. 12B indicate components or features that are similar to components or features having reference numerals preceded by the number "11" shown in FIG. 11A, FIG. 11B, FIG. 11C or FIG. 11D, by the number "10" shown in FIG. 10A or FIG. 10B, by the number "9" shown in FIG. 9A, FIG. 9B, FIG. 9C or FIG. 9D, by the number "8" shown in FIG. 8A or FIG. 8B, by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

The basket 1250 includes a pair of long sides 1252, a pair of short sides 1254 and a bottom 1256 that define a tapered, frustopyramidal volume 1255. The basket 1250 also includes slots 1258 provided at each corner of the basket 1250 along an upper perimeter thereof for accommodating one or more tabs or extensions of a bag (not shown) to be nested therein. Additionally, each of the short sides 1254 includes a slotted handle 1270 provided thereon, near an upper perimeter of the basket 1250, and each of the long sides 1252 includes a pair of mounting bores 1272 and a pair of extensions 1274 provided about central portions of the respective long sides 1252 which have heights that are substantially lower than the rest of the long sides 1252. The basket 1250 further includes a pair of pivotable handles 1260 that may be mounted to the bores 1272 provided at the central portions of the long sides 1252.

Additionally, as is shown in FIG. 12A, the basket 1250 further includes a rounded shelf 1253 provided about the upper perimeter of the basket 1250. The shelf 1253 extends laterally outward from an interior of the volume 1255 and is supported by a plurality of corbels 1257 spaced at regular or irregular intervals about the upper perimeter of the basket 1250. The shelf 1253 thus provides a structural surface onto which a bag (not shown) may rest, and further enhances the strength and durability of the basket 1250 in tension, particularly where the basket 1250 is formed in a single integral mold.

Referring to FIG. 12A, each of the handles 1260 is provided in a first position $P_1$, in which the handles 1260 are folded down and closely conform to the upper perimeter of the basket 1250. As is shown in FIG. 12A, each of the handles 1260 includes a pair of extension tabs 1264 on opposite sides that are aligned to come into contact with an upper edge of one of the long sides 1252 and a narrowed handle grip 1266 that is aligned to come into contact with and rest atop an upper edge of a corresponding short side 1254.

Referring to FIG. 12B, each of the handles 1260 is provided in a second position $P_2$, in which the handles 1260 are folded up into contact with one another substantially over a centroid of the basket 1250. As is shown in FIG. 12B, when the handles 1260 are in contact with one another in the second position $P_2$, the narrowed handle grips 1266 effectively combine to form a single grip that may be grasped by a user when holding or carrying the basket 1250 and any items therein. The extensions 1274 are provided to limit the extent to which a single handle 1260 may pivot or rotate beyond the second position $P_2$, and act as mechanical stops which halt the pivoting or rotation of a single handle 1260 at a predetermined angle.

In some implementations, the baskets of the present disclosure may include slots or other openings that are provided near or about their upper perimeters, e.g., within one or more of their respective corners, and configured to receive specific portions of bags such as tabs or other extensions therein. The locations or dimensions of such slots or openings may be selected based on the locations or dimensions of such tabs or extensions, and the materials from which such tabs or extensions are formed, such that the slots or openings maintain the tabs or extensions therein, thereby maintaining the bags nested within the baskets.

Figure 13A:
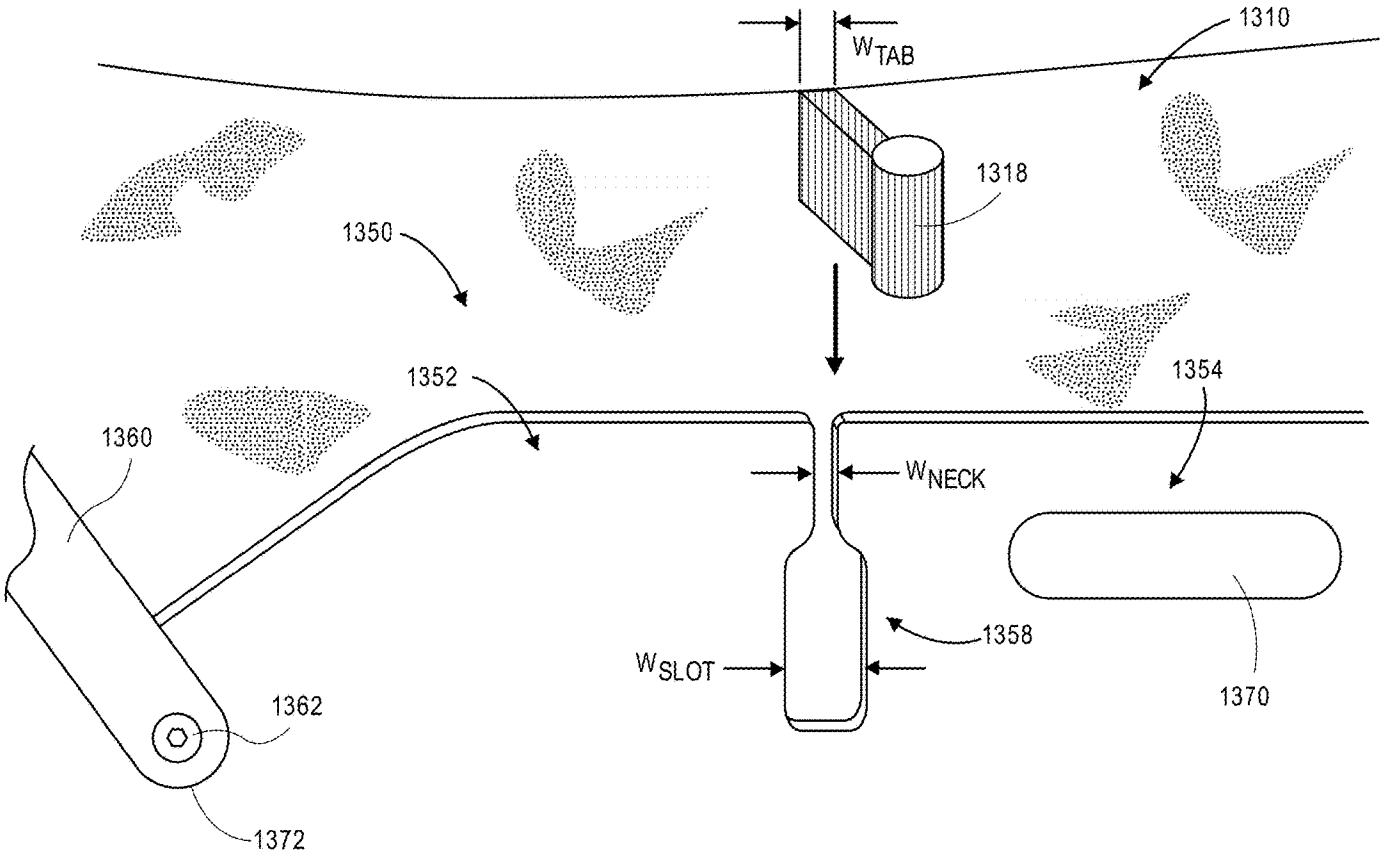
FIGS. 13A, 13B and 13C are views of components of one combination carrying device in accordance with implementations of the present disclosure.
Figure 13B:
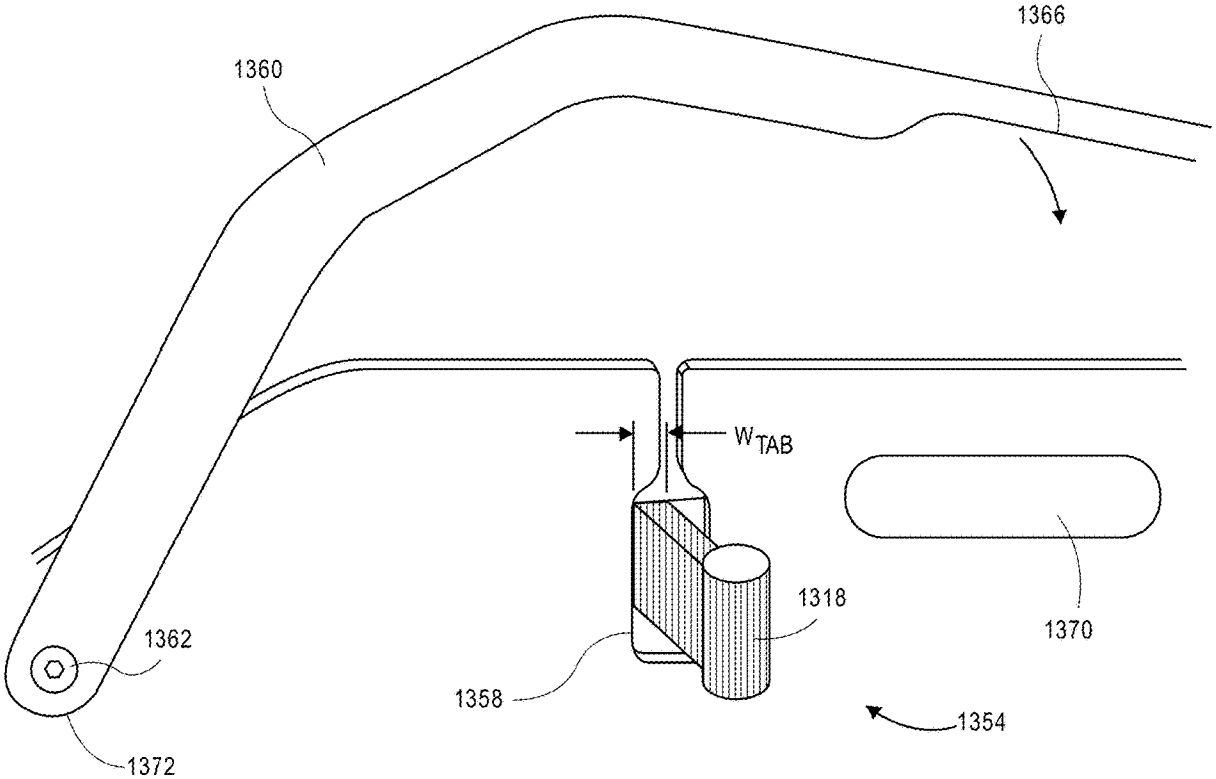
Figure 13C:
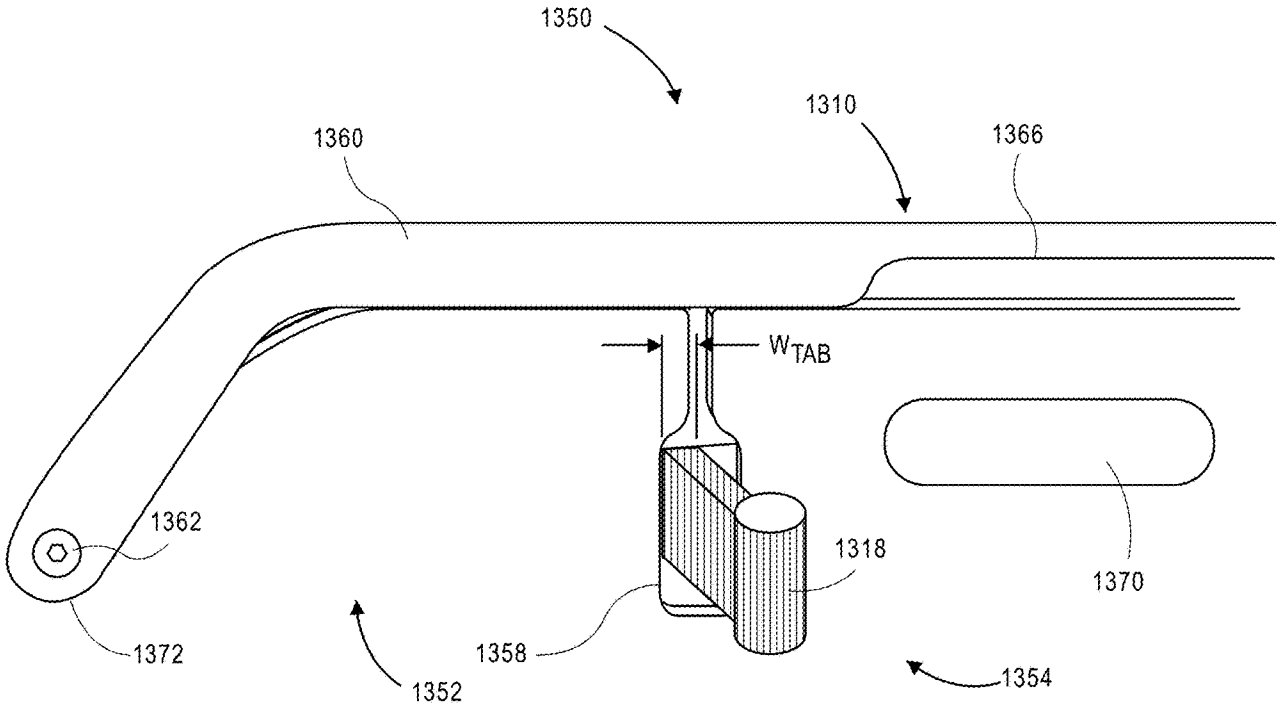

Referring to FIGS. 13A, 13B and 13C, views of one basket 1350 for use in embodiments of combination carrying devices in accordance with the present disclosure are shown. Except where otherwise noted, reference numerals preceded by the number "13" shown in FIG. 13A, FIG. 13B or FIG. 13C indicate components or features that are similar to components or features having reference numerals preceded by the number "12" shown in FIG. 12A or FIG. 12B, by the number "11" shown in FIG. 11A, FIG. 11B, FIG. 11C or FIG. 11D, by the number "10" shown in FIG. 10A or FIG. 10B, by the number "9" shown in FIG. 9A, FIG. 9B, FIG. 9C or FIG. 9D, by the number "8" shown in FIG. 8A or FIG. 8B, by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

A portion of the basket 1350 shown in FIG. 13A includes a corner defined by the long side 1352 and the short side 1354. The long side 1352 includes a pivotable handle 1360 mounted thereto at a mounting bore 1372 by a fastener 1362. The short side 1354 includes a slotted handle 1370 defined by an opening therein.

As is shown in FIG. 13A, the basket 1350 is adapted to receive a bag 1310 nested therein. In some implementations, the bag 1310 may be formed from one or more fabrics or fabric-based materials, e.g., knitted, woven or non-woven fabrics, natural or synthetic leathers or canvases, and the basket 1350 may be formed from one or more durable materials such as plastics, woods, metals or composites. As is also shown in FIG. 13A, the corner of the basket 1350 defined by the long side 1352 and the short side 1354 includes a slot 1358 having a main portion and a narrowed neck that is configured to receive a tab 1318 of the bag 1310 therein. The main portion of the slot 1358 has a width $w_{SLOT}$, while the narrowed neck of the slot 1358 has a width $w_{NECK}$, and the tab 1318 has a width $w_{TAB}$. In accordance with the present disclosure, the width $w_{TAB}$ of the tab 1318 may exceed the width $w_{NECK}$ of the narrowed neck, and may be less than the width $w_{SLOT}$. In this regard, the tab 1318 may be manually compressed or squeezed in order to enable the tab 1318 to pass through the narrowed neck.

As is shown in FIG. 13B and in FIG. 13C, after the tab 1318 has been inserted into the slot 1358, the handle 1360 may be rotated down from a second position, e.g., a position that is substantially above a centroid of the basket 1350, to a first position, e.g., a position in which the handle 1360 closely conforms to a portion of the upper perimeter of the basket 1350, effectively locking the tab 1318 in place within the slot 1358, and thereby ensuring that the bag 1310 remains nested within the basket 1350. Those of ordinary skill in the pertinent arts will recognize that when tabs 1318 of bags 1310 are received within a plurality of baskets 1350, thereby nesting the bags 1310 within the baskets 1350, and the handles 1360 are rotated down to closely conform to the upper perimeter of the baskets 1350, such as is shown in FIG. 13C, a plurality of the baskets 1350 may be stacked atop one another with the bags 1310 nested therein. Thus, when a user removes one of the baskets 1350 from the stack, the bags 1310 of the other baskets 1350 will remain nested therein.

Figure 14A:
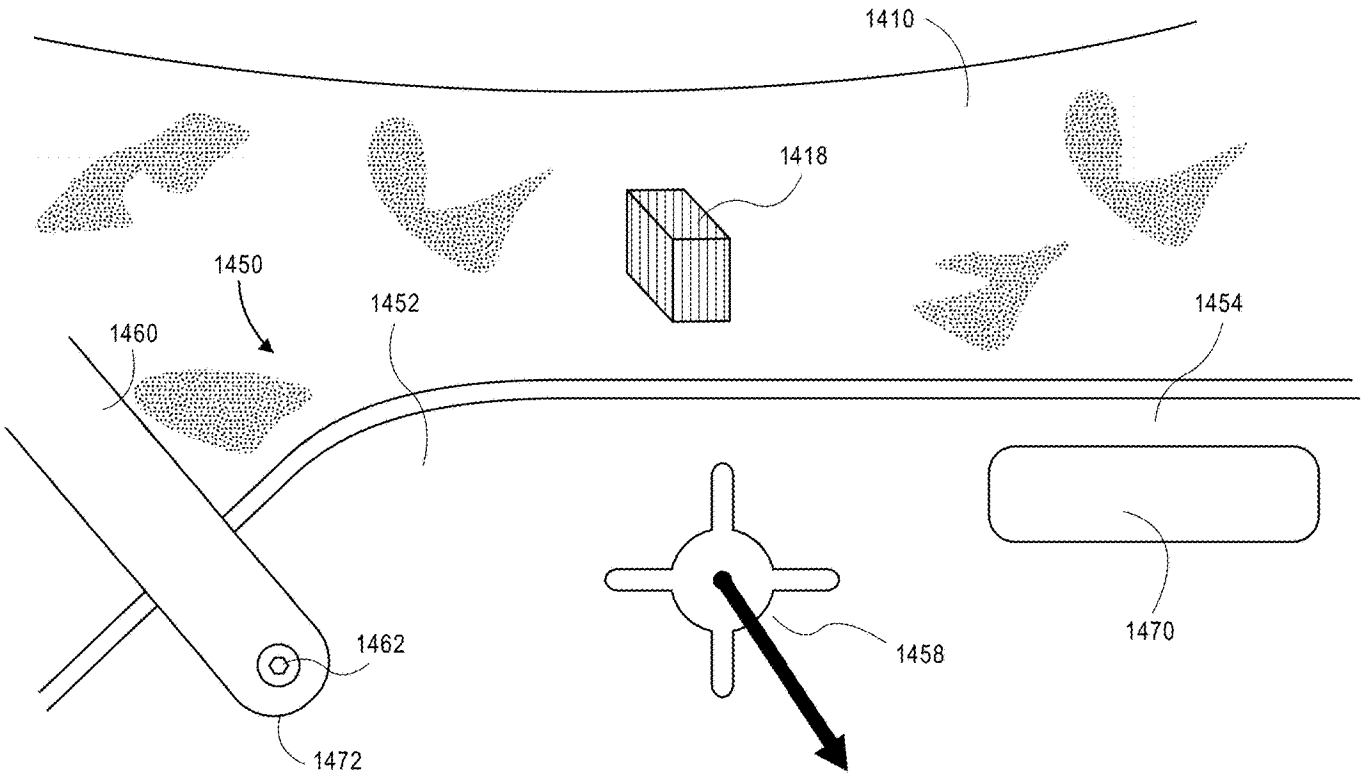
FIGS. 14A and 14B views of components of one combination carrying device in accordance with implementations of the present disclosure.
Figure 14B:
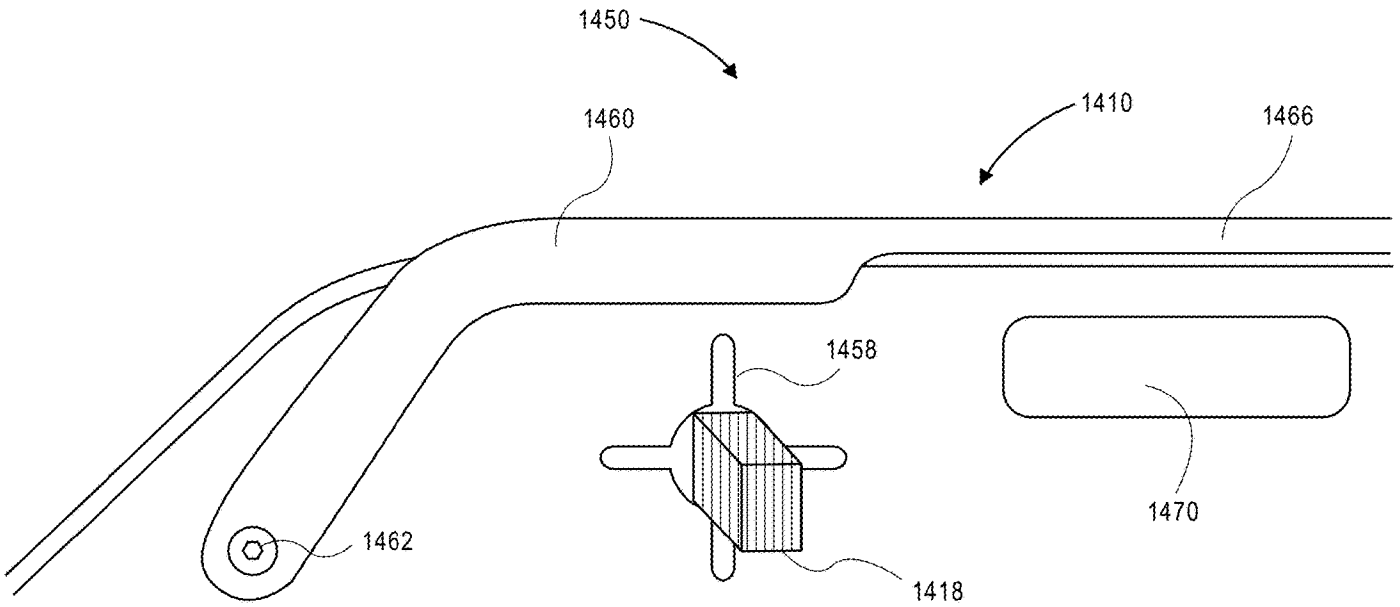

Referring to FIGS. 14A and 14B, views of one basket 1450 for use in embodiments of combination carrying devices in accordance with the present disclosure are shown. Except where otherwise noted, reference numerals preceded by the number "14" shown in FIG. 14A or FIG. 14B indicate components or features that are similar to components or features having reference numerals preceded by the number "13" shown in FIG. 13A, FIG. 13B or FIG. 13C, by the number "12" shown in FIG. 12A or FIG. 12B, by the number "11" shown in FIG. 11A, FIG. 11B, FIG. 11C or FIG. 11D, by the number "10" shown in FIG. 10A or FIG. 10B, by the number "9" shown in FIG. 9A, FIG. 9B, FIG. 9C or FIG. 9D, by the number "8" shown in FIG. 8A or FIG. 8B, by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

A portion of the basket 1450 shown in FIG. 14A also includes a corner defined by the long side 1452 and the short side 1454. The long side 1452 includes a pivotable handle 1460 mounted thereto at a mounting bore 1472 by a fastener 1462. The short side 1454 includes a slotted handle 1470 defined by an opening therein.

As is shown in FIG. 14A, the corner of the basket 1450 defined by the long side 1452 and the short side 1454 includes a slot 1458 having a main portion and a narrowed neck that is configured to receive a tab 1418 of the bag 1410 therein. The slot 1458 defines a cross-shaped pass-through channel having narrow slits and a round central opening that may accommodate a tab 1418 of the bag 1410 therein. In some implementations, the slot 1458, or the basket 1450 as a whole, may be formed of a flexible plastic material that may bend or otherwise deform to accommodate all or a portion of the tab 1418, which may include one or more dimensions that exceed one or more dimensions of the slot 1458. In this regard, the tab 1418 may be manually compressed or squeezed in order to enable the tab 1418 to pass through the slot 1458, and the bag 1410 may be maintained in a nested condition within the basket 1450 due to friction between the slot 1458 and the tab 1418.

As is shown in FIG. 14B, after the tab 1418 has been inserted into the slot 1458, the handle 1450 may be rotated down from a second position, e.g., a position that is substantially above a centroid of the basket 1450, to a first position, e.g., a position in which the handle 1460 closely conforms to a portion of the upper perimeter of the basket 1450, thereby enabling a plurality of the baskets 1450 to be stacked atop one another with the bags 1410 nested therein. Thus, when a user removes one of the baskets 1450 from the stack, the bags 1410 of the other baskets 1450 will remain nested therein due to the friction between the corresponding slot 1458 and the corresponding tab 1418.

Although some of the implementations of the combination carrying devices disclosed herein include bags having tabs or other extensions that are received within slots or like openings of baskets in order to nest the bags within the baskets, the systems and methods disclosed herein are not so limited. Rather, implementations of the present disclosure may include or comprise bags that are nested within baskets by any device, method or system, including but not limited to buttons, plastic tapes or adhesives, rivets, snaps, hook-and-loop fasteners (e.g., Velcro), elastics or the like. Likewise, the tabs or other extensions themselves need not be formed from the same materials as the bags to which such tabs or extension are joined. For example, a tab or extension may include or be formed from a plastic, a composite or a like material that may be stitched or combined with a bag by any means.

As is discussed above, in some implementations, the combination carrying devices of the present disclosure may be provided in a stack, with each of the baskets of such devices having a bag nested therein. The baskets may further include one or more sections or components which cause the handles of a basket to automatically pivot or rotate from a first position closely conforming to an upper perimeter of the basket to a second position at which the handles are joined above or about a center of the basket.

Referring to FIGS. 15A through 15E, views of one basket 1550 for use in embodiments of combination carrying devices in accordance with the present disclosure are shown. Except where otherwise noted, reference numerals preceded by the number "14" shown in FIG. 14A or FIG. 14B indicate components or features that are similar to components or features having reference numerals preceded by the number "14" shown in FIG. 14A or FIG. 14B, by the number "13" shown in FIG. 13A, FIG. 13B or FIG. 13C, by the number "12" shown in FIG. 12A or FIG. 12B, by the number "11" shown in FIG. 11A, FIG. 11B, FIG. 11C or FIG. 11D, by the number "10" shown in FIG. 10A or FIG. 10B, by the number "9" shown in FIG. 9A, FIG. 9B, FIG. 9C or FIG. 9D, by the number "8" shown in FIG. 8A or FIG. 8B, by the number "7" shown in FIG. 7A or FIG. 7B, by the number "6" shown in FIG. 6A or FIG. 6D, by the number "5" shown in FIG. 5A, FIG. 5B, FIG. 5C or FIG. 5D, by the number "4" shown in FIG. 4, by the number "3" shown in FIG. 3A or 3B, by the number "2" shown in FIG. 2A or 2B, or by the number "1" shown in FIGS. 1A and 1B.

Figure 15A:
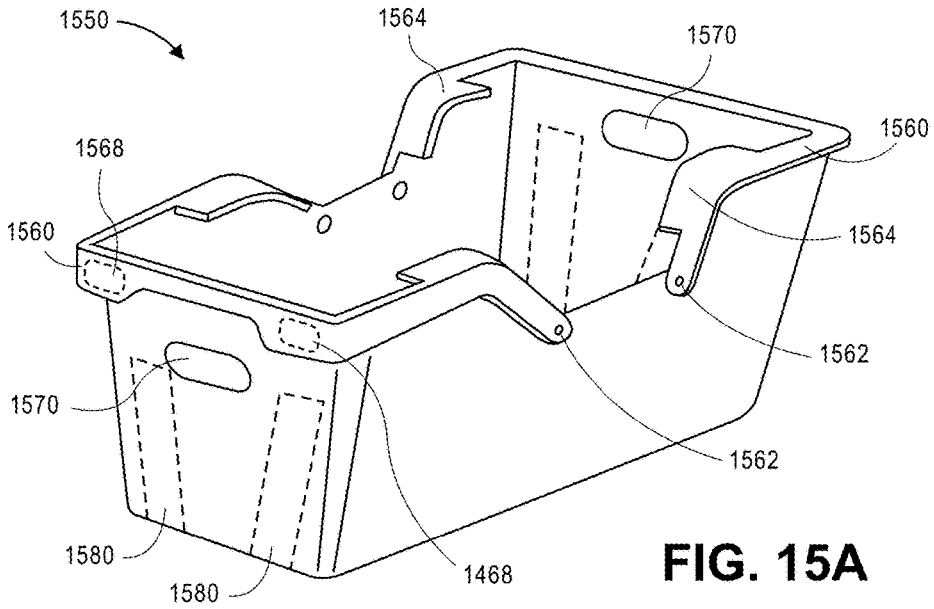
FIGS. 15A through 15E are views of components of one combination carrying device in accordance with implementations of the present disclosure.
Figure 15B:
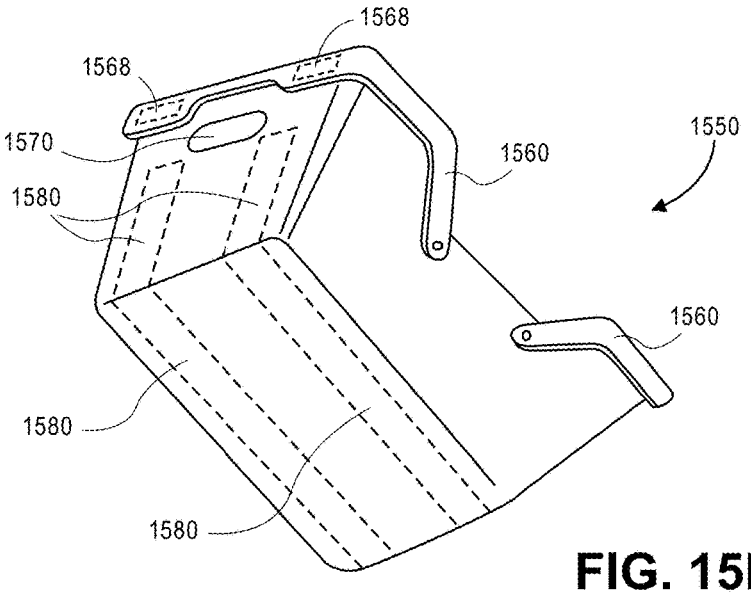

As is shown in FIGS. 15A and 15B, the basket 1550 includes a pair of long sides 1552, a pair of short sides 1554 and a bottom 1556. The basket 1550 further includes a pair of handles 1560 mounted or otherwise attached to the long sides 1552 using fasteners 1562, with each of the handles 1560 including an angled extension 1564 aligned to come into contact with a portion of an upper perimeter of the long sides 1552. The short sides 1554 of the basket 1550 include a slotted handle 1570 defined by an opening therein.

Additionally, as is also shown in FIGS. 15A and 15B, the basket 1550 further includes a pair of magnetized elements 1580 extending from one short side 1554, along the bottom 1556, and to another short side 1554. The handles 1560 include corresponding magnetized elements 1568 provided in discrete portions. The magnetized elements 1580 of the basket 1550 and the magnetized elements 1568 of the handles 1560 may be any type or form of magnetized components that are attracted to one another, e.g., of opposite polarities, including but not limited to permanent magnets, temporary magnets, electromagnets or any like magnetic device. In some implementations, the magnetized elements 1580 and the magnetized elements 1568 include or comprise rare earth magnets having opposite polarities, such that the magnetized elements 1580 and the magnetized elements 1568 are attracted to one another. Additionally, in some implementations, the magnetized elements 1580 and the magnetized elements 1568 may be formed from or include thin, low-friction and low-reluctance shields which do not restrict or inhibit the magnetic fields generated thereby or associated therewith, and further permit the magnetized elements 1568 to remain in slidable contact with the magnetized elements 1580

Figure 15C:
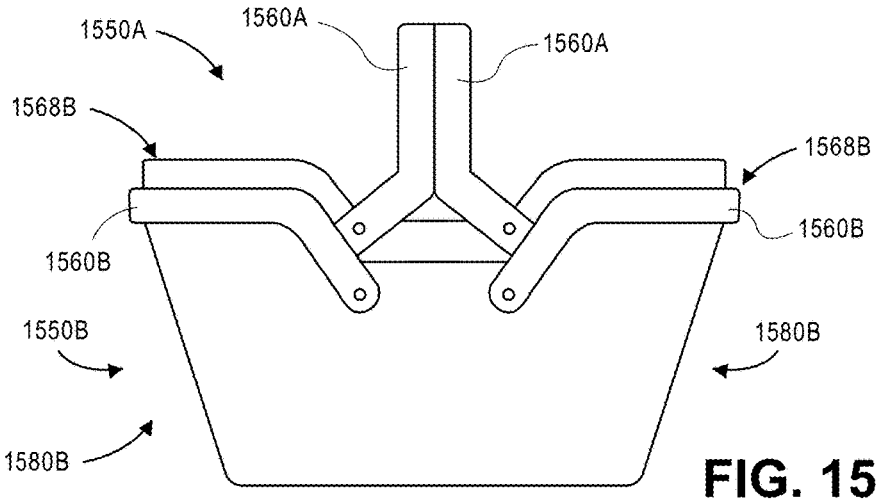

The locations of the magnetized elements 1580 of the basket 1550 and the magnetized elements 1568 of the handles 1560 may be selected such that the magnetized elements 1568 provided on handles 1560 of one basket 1550 are attracted to, and may in fact come into contact with, the magnetized elements 1580 provided on another basket 1550, particularly when a plurality of combination carrying devices including the baskets 1550 are stacked on top of one another with bags nested therein. Referring to FIG. 15C, a pair of the baskets 1550A, 1550B of FIG. 15A or FIG. 15B are shown in a stack, with the basket 1550A provided at least in part within the basket 1550B. Each of the baskets 1550A, 1550B includes a pair of handles 1560A, 1560B and a magnetized element 1580A, 1580B provided on outer surfaces thereof, with each of the pair of handles 1560A, 1560B further including magnetized elements 1568A, 1568B provided thereon. As is shown in FIG. 15C, the handles 1560A of the basket 1550A are folded upward and into contact with one another above the basket 1550A, while the handles 1560B of the basket 1550B are folded downward and rest along upper perimeters of the basket 1560B.

Figure 15D:
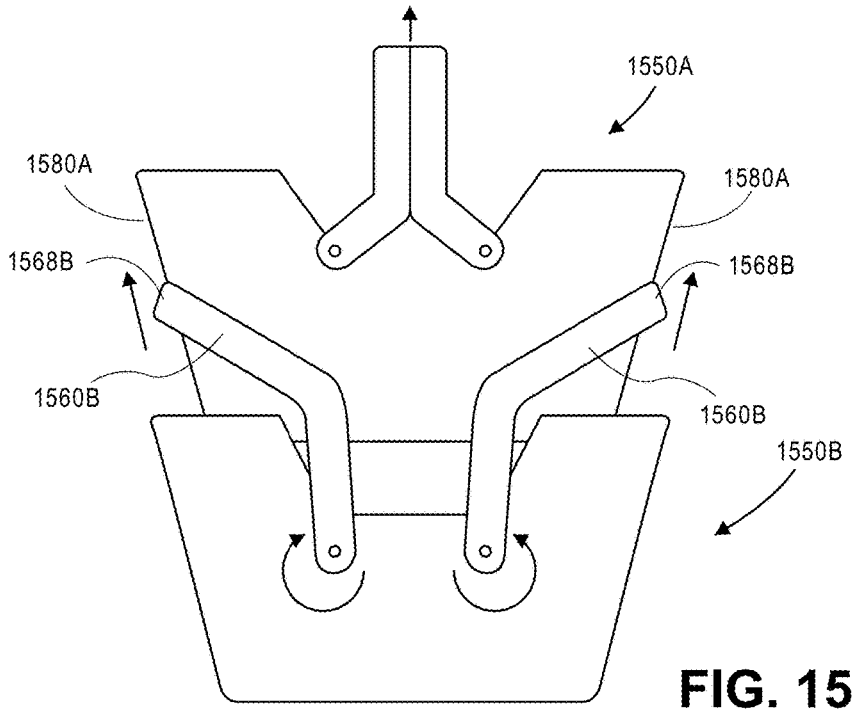
Figure 15E:
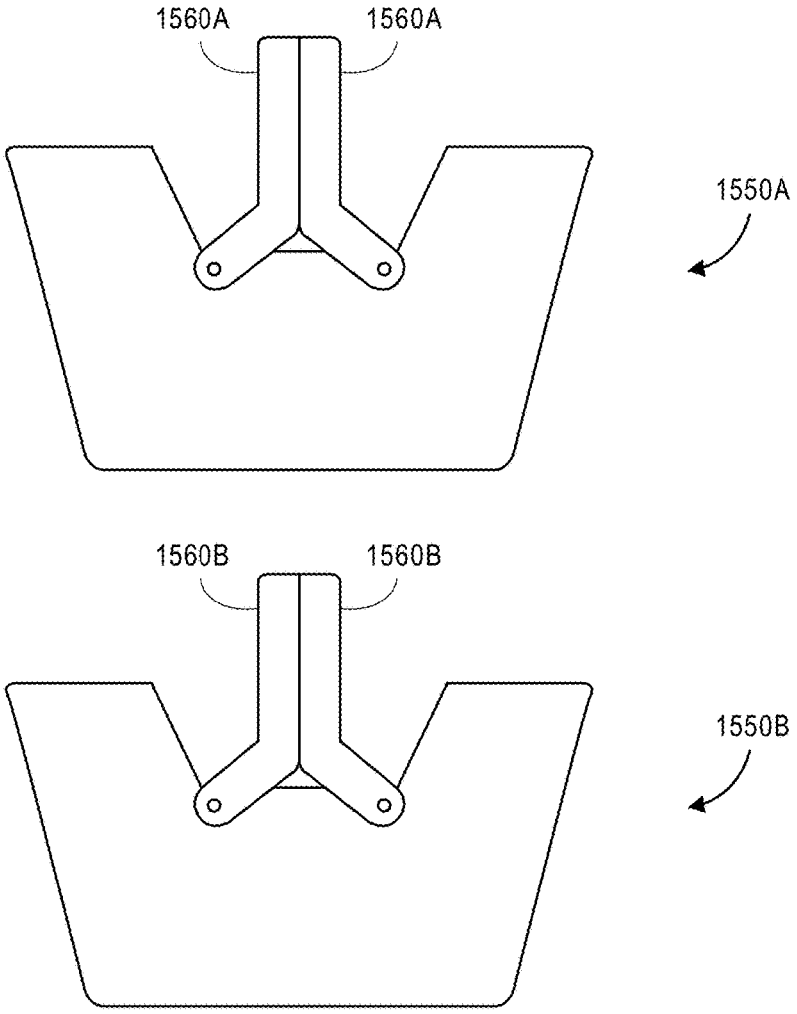

Referring to FIG. 15D, the baskets 1550A, 1550B of FIG. 15C are shown, with the basket 1550A being lifted up from the basket 1550B. As is shown in FIG. 15D, the magnetized elements 1568B of the handles 1560B of the basket 1550B are shown as being drawn into contact with the magnetized elements 1580A provided on the outer surfaces of the basket 1550A. As the basket 1550A is lifted from the basket 1550B, the handles 1560B slide along the outer surfaces of the basket 1550A, in order to maintain the magnetized elements 1568B in contact with the magnetized elements 1580A, and are thus lifted upward from the upper perimeter of the basket 1550B. Referring to FIG. 15E, the baskets 1550A, 1550B are shown as being completely separated from one another, with the handles 1560A, 1560B of each of the baskets 1550A, 1550B being raised into positions above the respective centroids of the baskets 1550A, 1550B.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. Although some of the implementations of the combination carrying devices disclosed herein include bags and baskets having corresponding frustopyramidal volumes, the present disclosure is not so limited, and bags and baskets having any corresponding shape or volume, e.g., any type or form of polyhedron or other three-dimensional shape. For example, the combination carrying devices of the present disclosure may include bags and baskets having corresponding frustoconical volumes, e.g., hollow cavities having shapes corresponding to a frustrum of a cone, or a conic frustrum, for receiving one or more items therein. Alternatively, the combination carrying devices of the present disclosure may include bags and baskets having tapered volumes which correspond to one another, e.g., with corresponding cross-sectional shapes and/or areas and one or more continuous surfaces. For example, in some implementations, the bags and baskets may each feature volumes having ellipsoidal, circular, triangular, hexagonal or other regularly or irregularly shaped cross-sections that correspond to one another. The dimensions, types or sizes of the cross-sectional areas or shapes of the bags and baskets of the combination carrying devices disclosed herein are not limited. Furthermore, while some of the labels assigned to sides or panels of the bags or baskets described herein may represent lengths or positions (e.g., "long" or "short"), other labels may be purely arbitrary (e.g., "side" or "end").

Additionally, the bags of the present disclosure are also not limited for use in connection with non-wheeled baskets, such as those discussed herein. Rather, one or more of the bags disclosed herein may be releasably nested within a wheeled cart or other like apparatus, and may feature a volume that corresponds to a volume of the cart or other apparatus. In this regard, when a user has completed the picking of items into the cart, the user may simply extract the bag from the cart by one or more handles provided thereon.

Moreover, although some of the baskets of the present disclosure are described as having handles that may pivot or rotate between a first position and a second position, the baskets disclosed herein are not so limited. Rather, the handles may pivot or rotate to any position between an upper perimeter of a basket and a position located substantially above a centroid or midpoint of the basket, along a continuous or substantially continuous arc.

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain implementations could include, or have the potential to include, but do not mandate or require, certain features, elements and/or steps. In a similar manner, terms such as "include," "including" and "includes are generally intended to mean "including, but not limited to." Thus, such conditional language is not generally intended to imply that features, elements and/or steps are in any way required for one or more implementations or that one or more implementations necessarily include logic for deciding, with or without user input or prompting, whether these features, elements and/or steps are included or are to be performed in any particular implementation.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. A carrying device comprising:

a basket including:

a first carrying volume defined by a first long side, a second long side, a first short side, a second short side, and a first bottom, wherein the first carrying volume has a first tapered shape, wherein each of the first long side, the second long side, the first short side, the second short side and the first bottom is formed from a rigid plastic material, and wherein the first carrying volume comprises at least one slot provided on an inner corner of the first carrying volume defined by the first long side and the first short side;

a first slotted handle provided in the first short side;

a second slotted handle provided in the second short side;

a first pivotable handle comprising a first end pivotably attached to a first location on the first long side, a first extension, a first grip, a second extension, and a second end pivotably attached to a second location on the second long side, wherein the first pivotable handle is configured to pivot between:

a first position in which the first extension is in contact with at least a first upper edge of the first long side, or the second extension is in contact with at least a second upper edge of the second long side, and at least a second position in which at least the first grip is located substantially over a centroid of the basket;

a second pivotable handle comprising a third end pivotably attached to a third location of the first long side, a third extension, a second grip, a fourth extension and a fourth end pivotably attached to a fourth location of the second long side, wherein the second pivotable handle is configured to pivot between:

a third position in which the third extension is in contact with at least a third upper edge of the first long side, or the fourth extension is in contact with at least a fourth upper edge of the second long side, and at least a fourth position in which at least the second grip is located substantially over the centroid of the basket; and a bag including:

a second carrying volume, smaller than the first carrying volume, defined by a third long side, a fourth long side, a third short side, a fourth short side, and a third bottom, wherein the second carrying volume defines a second tapered shape corresponding to the first tapered shape, and wherein the bag comprises at least one stitched tab provided on an outer corner defined by the third long side and the third short side, and wherein the at least one stitched tab is configured to be inserted into the at least one slot; and a first portion configured to releasably mate with at least a second portion of the basket, wherein the bag is formed from at least one of a canvas, a leather or a fabric, and wherein a first surface of the first grip comes into contact with a second surface of the second grip when the first pivotable handle is in the second position and the second pivotable handle is in the fourth position.

2. The carrying device of claim 1, wherein the first location of the first long side comprises a first mounting bore having a first substantially horizontal circular opening and a first substantially vertical face, wherein the second location of the second long side comprises a second mounting bore having a second substantially horizontal circular opening and a second substantially vertical face, wherein the first end of the first handle is pivotably attached to the first location of the first long side by a first fastener provided through the first substantially horizontal circular opening of the first mounting bore, wherein the first end of the first handle is configured to rotate within a first plane defined by the first substantially vertical face, wherein the second end of the first handle is pivotably attached to the second location of the second long side by a second fastener provided through the second substantially horizontal circular opening of the second mounting bore, and wherein the second end of the first handle is configured to rotate within a second plane defined by the second substantially vertical face.

3. The carrying device of claim 1, wherein the first long side further comprises a first angled section having a fifth upper edge provided at a first angle with respect to the first upper edge and a second angled section having a sixth upper edge provided at a second angle with respect to the third upper edge, wherein the first extension comprises a first portion and a second portion provided at the first angle with respect to the first portion, wherein the second extension comprises a third portion and a fourth portion provided at the second angle with respect to the third portion, wherein the first portion of the first extension is in contact with the first upper edge and the second portion of the first extension is in contact with the fifth upper edge when the first handle is in the first position, and wherein the third portion of the second extension is in contact with the third upper edge and the fourth portion of the second extension is in contact with the sixth upper edge when the second handle is in the third position.

4. The carrying device of claim 1, wherein the first portion of the bag is a pocket along the third short side, wherein the second portion of the basket is a portion of one of the first short side or the second short side, wherein the portion of the one of the first short side or the second short side extends between a first slot provided at an intersection of the first long side with the one of the first short side or the second short side and an intersection of the second long side with the one of the first short side or the second short side, and wherein the pocket is configured to releasably mate with the second portion of the basket.

5. A first durable item carrier comprising:

a first side panel including at least one first section having a first height and a second section having a second height, wherein the first height exceeds the second height;

a second side panel including at least one third section having the first height and a fourth section having the second height;

a third side panel having the first height, wherein the third side panel is joined to the first side panel and the second side panel;

a fourth side panel having the first height, wherein the fourth side panel is joined to the first side panel and the second side panel;

at least one slot provided on an inner corner of the first durable item carrier defined by the first side panel and the third side panel;

a bottom panel having a first edge, a second edge, a third edge and a fourth edge, wherein a first lower edge of the first side panel is joined to the first edge, wherein a second lower edge of the second side panel is joined to the second edge, wherein a third lower edge of the third side panel is joined to the third edge, and wherein a fourth lower edge of the fourth side panel is joined to the fourth edge;

a first handle having a first end pivotably attached to the second section of the first side panel and a second end pivotably attached to the fourth section of the second side panel; and a second handle having a third end pivotably attached to the second section of the first side panel and a fourth end pivotably attached to the fourth section of the second side panel, wherein at least the first side panel, the second side panel, the third side panel, the fourth side panel, and the bottom panel define a first tapered volume, wherein at least one of a shape or a size of the first tapered volume corresponds to at least one of a shape or a size of a second tapered volume of a flexible item carrier having at least one stitched tab on an outer corner defined by a first side panel of the flexible item carrier and a second side panel of the flexible item carrier, and wherein the at least one stitched tab is configured to be inserted into the at least one slot.

6. The first durable item carrier of claim 5, wherein the first side panel of the first durable item carrier further includes at least one fifth section extending between the at least one first section and the second section, and wherein an upper edge of the at least one fifth section comprises an angled portion extending between the first height of the at least one first section and the second height of the at least one second section.

7. The first durable item carrier of claim 6, wherein the first handle is formed in a shape corresponding at least in part to at least a portion of an upper perimeter of the first durable item carrier, wherein the portion of the upper perimeter comprises an upper edge of the third side panel of the first durable item carrier, an upper edge of the at least one first section of the first side panel of the first durable item carrier and the upper edge of the at least one fifth section of the first side panel of the first durable item carrier.

8. The first durable item carrier of claim 6, wherein the upper edge of the at least one fifth section of the first side panel is provided at an angle of approximately one hundred twenty degrees with respect to the upper edge of the at least one first section of the first side panel of the first durable item carrier.

9. The first durable item carrier of claim 7, wherein the first handle is configured to pivot between a first position corresponding to the portion of the upper perimeter of the first durable item carrier and at least a second position over a centroid of the first durable item carrier.

10. The first durable item carrier of claim 7, wherein the first handle comprises at least one mechanical stop having a first planar extension and a second planar extension provided thereon, and wherein the first planar extension is configured to contact at least a portion of the upper edge of the at least one first section and at least a portion of the upper edge of the at least one fifth section.

11. The first durable item carrier of claim 7, wherein the second section of the first side panel of the first durable item carrier comprises a first circular mounting bore having a first substantially vertical face, wherein the fourth section of the second side panel of the first durable item carrier comprises a second circular mounting bore having a second substantially vertical face, wherein the first end of the first handle is pivotably attached to the second section of the first side panel of the first durable item carrier at the first circular mounting bore, wherein the first end of the first handle is configured to pivot within a first plane defined by the first substantially vertical face, wherein the second end of the first handle is pivotably attached to the fourth section of the second side panel of the first durable item carrier at the second circular mounting bore, and wherein the second end of the first handle is configured to pivot within a second plane defined by the second substantially vertical face.

12. The first durable item carrier of claim 11, wherein the first end of the first handle is pivotably attached to the second section of the first side panel of the first durable item carrier at the first circular mounting bore by at least one of a bolt, a screw or a rivet.

13. The first durable item carrier of claim 5, wherein the first handle is adapted to pivot between a first position resting on a first portion of an upper perimeter of the first durable item carrier and at least a second position substantially above a centroid of the first durable item carrier, and wherein the second handle is adapted to pivot between a third position resting on a second portion of the upper perimeter of the first durable item carrier and at least a fourth position substantially above the centroid of the first durable item carrier.

14. The first durable item carrier of claim 13, wherein the first handle comprises a first grip having a first flat surface and a first rounded edge, wherein the second handle comprises a second grip having a second flat surface and a second rounded edge, and wherein the first flat surface comes into contact with the second flat surface when the first handle is in the second position and when the second handle is in the fourth position.

15. The first durable item carrier of claim 5, wherein the first end of the first handle has a first cross-sectional area, wherein a first grip of the first handle has a second cross-sectional area, and wherein the first cross-sectional area is greater than the second cross-sectional area.

16. The first durable item carrier of claim 13, wherein the first handle comprises a first magnetized element of a first polarity, and wherein the first magnetized element is aligned to contact a second magnetized element of a second polarity provided on at least one of a first side panel of a second durable item carrier, a second side panel of the second durable item carrier or a bottom panel of the second durable item carrier when the second durable item carrier is removed from the first durable item carrier.

17. The first durable item carrier of claim 5, further comprising a first slot provided at a first inner corner of the first durable item carrier defined by the first side panel of the first durable item carrier and the third side panel of the first durable item carrier and a second slot provided at a second inner corner of the first durable item carrier defined by the second side panel of the first durable item carrier and the third side panel of the first durable item carrier, wherein the flexible item carrier further comprises at least one pocket provided on at least a portion of a third end panel of the flexible item carrier, and wherein the at least one pocket is configured to receive at least a portion of the third side panel of the first durable item carrier between the first slot and the second slot.

18. The first durable item carrier of claim 5, further comprising at least one of a button, an adhesive, a rivet, a snap, an elastic or a hook-and-loop fastener for mating the flexible item carrier to the first durable item carrier.

19. The first durable item carrier of claim 5, wherein the flexible item carrier is formed from at least one of:

a woven fabric comprising one or more plastic fibers;

a woven fabric comprising one or more natural fibers;

a woven fabric comprising one or more paper fibers;

at least one leather; or at least one canvas.

20. The first durable item carrier of claim 5, wherein each of the first side panel of the first durable item carrier, the second side panel of the first durable item carrier, the third side panel of the first durable item carrier, the fourth side panel of the first durable item carrier and the bottom panel of the first durable item carrier is formed from a common plastic material.

21. The first durable item carrier of claim 20, wherein the common plastic material is one of:

an acrylonitrile butadiene styrene;

a bioplastic;

a compostable plastic;

an epoxy resin;

a natural plastic;
a phenolic resin;
a polyester;
a polyethylene;
a polypropylene;
a polyurethane;
a polyvinyl chloride; or
a recycled plastic.

22. The first durable item carrier of claim 5, wherein the first side panel of the first durable item carrier and the second side panel of the first durable item carrier have a first trapezoidal area, wherein the third side panel of the first durable item carrier and the fourth side panel of the first durable item carrier have a second trapezoidal area, and wherein the first trapezoidal area is greater than the second trapezoidal area.

23. The first durable item carrier of claim 5, further comprising a first corner panel having the first height, wherein the first side panel of the first durable item carrier is joined to the third side panel of the first durable item carrier via the first corner panel.

24. The first durable item carrier of claim 5, wherein the first side panel of the first durable item carrier is joined to the third side panel of the first durable item carrier at a first intersection, and wherein the first intersection is defined by at least one of a straight line or a curvilinear line.

25. A durable item carrier comprising:

a first cavity defining an open end having an upper perimeter and a closed end, wherein the first cavity includes at least one end section at a first height, at least one central section at a second height, and at least one angled section extending between the at least one end section and the at least one central section;

at least one slot provided on an inner corner of the upper perimeter;

at least a first circular mounting bore provided on the at least one central section;

at least a second circular mounting bore provided on the at least one central section;

a first handle rotatably attached to the first cavity by at least the first circular mounting bore, wherein the first handle has a shape corresponding to a first portion of the upper perimeter; and a second handle rotatably attached to the first cavity by at least the second circular mounting bore, wherein the second handle has a shape corresponding to a second portion of the upper perimeter, wherein the first cavity is formed from an injection-molded plastic, wherein at least one of a size or a shape of the first cavity corresponds to at least one of a size or a shape of a second cavity of a flexible item carrier comprising at least one stitched tab on an outer corner, wherein the first cavity is configured to releasably receive at least a portion of the second cavity therein, and wherein the at least one stitched tab is configured to be inserted into the at least one slot.

26. The durable item carrier of claim 25, wherein the first portion of the upper perimeter comprises a first upper surface of the at least one end section and a first upper surface of the at least one angled section, and wherein the first upper surface of the at least one angled section defines an angle of approximately one hundred twenty degrees with respect to the first upper surface of the at least one end section.

27. The durable item carrier of claim 26, wherein the first handle is configured to rotate about a first axis defined at least in part by the first circular mounting bore between a first position resting on the first portion of the upper perimeter and at least a second position substantially above a centroid of the durable item carrier, wherein the second handle is configured to rotate about a second axis defined at least in part by the second circular mounting bore between a third position resting on the second portion of the upper perimeter and at least a fourth position substantially above the centroid of the durable item carrier, and wherein the first handle and the second handle are configured to come into contact when the first handle is in the second position and the second handle is in the fourth position.

28. The durable item carrier of claim 27, wherein the first handle comprises at least one extension, wherein the at least one extension is configured to contact the first upper surface of the at least one end section and the first upper surface of the at least one angled section when the first handle is in the first position, and wherein at least a portion of the at least one extension is configured to contact a first upper surface of the at least one central section when the first handle is in the second position.

29. The durable item carrier of claim 25, further comprising at least a third handle defined by an opening in the at least one end section.

* * * * *